US010518189B2

(12) United States Patent
Lachance et al.

(10) Patent No.: US 10,518,189 B2
(45) Date of Patent: Dec. 31, 2019

(54) TOOL FOR USE WITH TOY CONSTRUCTION ELEMENTS

(71) Applicant: Mattel-MEGA Holdings (US), LLC, El Segundo, CA (US)

(72) Inventors: Amélie Lachance, Montreal (CA); Louis-Philippe Beaulieu, Montreal (CA); Steve Ross, St-Jacques (CA)

(73) Assignee: Mattel-MEGA Holdings (US), LLC, El Segundo, CA (US)

( * ) Notice: Subject to any disclaimer, the term of this patent is extended or adjusted under 35 U.S.C. 154(b) by 0 days.

(21) Appl. No.: 15/709,579

(22) Filed: Sep. 20, 2017

(65) Prior Publication Data

US 2019/0083893 A1 Mar. 21, 2019

(51) Int. Cl.
*A63H 33/04* (2006.01)
*A63H 33/08* (2006.01)

(52) U.S. Cl.
CPC ..... *A63H 33/042* (2013.01); *A63H 33/08* (2013.01)

(58) Field of Classification Search
CPC ..... A63H 33/042; A63H 33/08; A63H 33/108
See application file for complete search history.

(56) References Cited

U.S. PATENT DOCUMENTS

D31,975 S 12/1899 Hunsinger, Jr.
743,823 A 11/1903 Bryar
1,114,837 A 10/1914 Wilson
D164,467 S 9/1951 Arnold
3,656,375 A 4/1972 Reed et al.
3,713,246 A 1/1973 Kilroy, Jr.
3,736,696 A 6/1973 Laird et al.
D238,745 S 2/1976 Bedard et al.
4,009,743 A 3/1977 Ackerman
4,226,045 A * 10/1980 Lehmann ..... A63H 3/00 446/101
D263,673 S 4/1982 Sheehan
D269,495 S 6/1983 Finn
4,390,112 A 6/1983 Tysver
4,412,464 A 11/1983 Cook
4,522,088 A 6/1985 Berglund
(Continued)

FOREIGN PATENT DOCUMENTS

DE 10304092 A1 * 8/2004 ..... A63H 33/042
DE 10304092 A1 * 8/2004 ..... A63H 33/042
(Continued)

OTHER PUBLICATIONS

"LEGO Panel 2 x 5 x 6," Lego Part 4444, first produced 1984 according to: <URL:http://www.peeron.com/inv/parts/4444>, 2 pages.
(Continued)

*Primary Examiner* — Eugene L Kim
*Assistant Examiner* — Alyssa M Hylinski
(74) *Attorney, Agent, or Firm* — Plumsea Law Group, LLC

(57) ABSTRACT

A tool for separating blocks and other elements from an assembly of toy construction elements is disclosed. The tool may include a coupling end that can attach to pegs and/or openings in a block and is configured for easily prying off the block. The tool may include a moving member that can be used to configure the coupling end in two different configurations for coupling to either the top or bottom of a block.

20 Claims, 19 Drawing Sheets

(56) References Cited

U.S. PATENT DOCUMENTS

| | | | | | |
|---|---|---|---|---|---|
| D295,646 | S | * | 5/1988 | Knudsen | D21/492 |
| D303,687 | S | | 9/1989 | Poulsen | |
| D304,042 | S | | 10/1989 | Poulsen | |
| 4,949,600 | A | | 8/1990 | Tricinella | |
| D317,482 | S | * | 6/1991 | Michaelsen | D8/14 |
| 5,033,501 | A | | 7/1991 | Stehling | |
| 5,349,734 | A | * | 9/1994 | Poulsen | A63H 33/04 29/239 |
| 5,495,651 | A | | 3/1996 | Tsuha | |
| 5,768,956 | A | | 6/1998 | Coonrad | |
| D409,676 | S | | 5/1999 | Toft | |
| D411,262 | S | | 6/1999 | Toft | |
| D423,061 | S | | 4/2000 | Raundahl | |
| 6,200,187 | B1 | | 3/2001 | Olsen et al. | |
| 6,447,358 | B1 | | 9/2002 | Mikkelsen et al. | |
| 6,508,689 | B1 | | 1/2003 | Mikkelsen et al. | |
| D552,190 | S | | 10/2007 | Glickman et al. | |
| 7,481,692 | B2 | | 1/2009 | Bruder | |
| 8,024,994 | B2 | | 9/2011 | St. John et al. | |
| D689,954 | S | | 9/2013 | Rya | |
| 8,708,312 | B2 | | 4/2014 | Stawarski | |
| 8,713,773 | B2 | | 5/2014 | Foxx et al. | |
| D783,731 | S | | 4/2017 | Rosan | |
| 9,814,997 | B1 | * | 11/2017 | Vaillancourt | A63H 33/042 |
| D832,932 | S | | 11/2018 | Kogure | |
| D833,260 | S | | 11/2018 | Dumlao et al. | |
| 2011/0076909 | A1 | * | 3/2011 | Hageman | A63H 33/086 446/124 |
| 2013/0195547 | A1 | * | 8/2013 | De Wilde | A63H 33/101 403/330 |
| 2015/0174502 | A1 | * | 6/2015 | Saigo | A63H 33/086 446/124 |
| 2017/0007940 | A1 | | 1/2017 | Almog et al. | |
| 2017/0270815 | A1 | * | 9/2017 | Chen | A61B 5/168 |
| 2017/0282090 | A1 | * | 10/2017 | Chen | A63H 33/042 |

FOREIGN PATENT DOCUMENTS

| | | | |
|---|---|---|---|
| EP | 0464065 | B1 | 2/1994 |
| WO | 9011112 | A1 | 10/1990 |

OTHER PUBLICATIONS

"LEGO Panel 3 x 2 x 5 & 2/3," Lego Part 2448, first produced 1987 according to: <URL:http://www.peeron.com/inv/parts/2448>, 2 pages.
"LEGO Panel 3 x 2 x 6," Lego Part 2466, first produced 1988 according to: <URL:http://www.peeron.com/inv/parts/2466>, 3 pages.
"MEGA BLOKS Probuilder M1A1 Abrams Tank," MEGA Bloks Item #9734, MEGA Bloks Inc., 2002, 32 pages.
"Set #5954—Nano Dump Truck Review," May 3, 2009, retrieved from the Internet Oct. 31, 2017: <URL:https://web.archive.org/web/20090503170049/http://www.graysage.com/cg/Toys/Megabloks/Nano/5954/Index.html>.
"MEGA BLOKS Nano Building System 5983 Off Shore Racing," MEGA Bloks Inc., 2004, 56 pages.
"MEGA Bloks Set 9734 M1A1 Abrams Tank Image," Jul. 5, 2004, retrieved from the Internet Oct. 31, 2017: <URL:https://web.archive.org/web/20040705011917/http://www.graysage.com:80/cg/Toys/Megabloks/ProBuilder/M1A1AbramsTank/030323-024.jpg>.
"MEGA Bloks Set 5954 Image," Nov. 1, 2004, Retrieved from the Internet Oct. 31, 2017: <URL:https://web.archive.org/web/20041101035811/http://www.graysage.com:80/cg/Toys/Megabloks/Nano/5954/5954-010.jpg>.
"Set #9734—M1A1 Abrams Tank," Jul. 25, 2008, retrieved from the Internet Oct. 31, 2017: <URL:https://web.archive.org/web/20080725034138/http://www.graysage.com/cg/Toys/Megabloks/ProBuilder/M1A1AbramsTank/Index.html>.
Design U.S. Appl. No. 29/618,218, filed Sep. 20, 2017.
Amendment filed Apr. 1, 2019 in Design U.S. Appl. No. 29/618,218.
Office Action dated Jan. 10, 2019 in Design U.S. Appl. No. 29/618,218.

* cited by examiner

TOOL FOR USE WITH TOY CONSTRUCTION ELEMENTS

BACKGROUND

Field

The present embodiments relate generally to toy construction elements, and more particularly, to a tool that can be used to separate blocks, rods, and other construction elements.

Background

Interlocking stackable toy construction blocks are well known in the field of toys and games. Although blocks may come in various sizes and shapes, a typical block is rectangular in shape and has upwardly projecting pegs on its top surface arranged in a matrix, and coupling means on its bottom surface for releasably interlocking the block to the top of another similar toy construction block or other element having upwardly projecting pegs. Multiple blocks and elements of varying shapes and sizes may be assembled into various toy constructions, such as houses, cars, airplanes, spaceships, and animals.

SUMMARY

Embodiments provide a tool for use with a set of toy construction elements, such as blocks. The tool may have a body defining a lengthwise direction. The body may include a coupling end with an engagement surface. The tool may have a first configuration and a second configuration: in the first configuration the engagement surface may present at least one peg and in the second configuration the engagement surface may present at least one opening. The geometry of the coupling end may change as the tool transitions from the first configuration to the second configuration.

Another embodiment provides a tool for use with a set of toy construction elements, such as blocks. The tool may include a body and a moving member, where the moving member includes at least one peg. The body may include a coupling end and the coupling end may include at least one opening. The moving member may be moveable along the body between a first position and a second position. As the moving member moves between the first position and the second position, the peg may move through the opening.

Another embodiment provides a tool for use with a set of toy construction elements, such as blocks. The tool may include a body defining a lengthwise direction. The body may include a coupling end with a first opening and a second opening. The coupling end may have an outer perimeter that lies in a plane perpendicular to the lengthwise direction. The outer perimeter may include a first edge, a second edge, a third edge, and a fourth edge. A center of the first opening and a center of the second opening may be spaced apart by a peg separation distance. Each of the first edge, the second edge, the third edge, and the fourth edge may lie within the peg separation distance of at least one of the first opening or the second opening.

Embodiments also provide a tool for use with a set of toy construction elements, such as blocks, where the tool includes a body with a first elongated portion and a second elongated portion. The first elongated portion and the second elongated portion may be separated by a slot. The first elongated portion and the second elongated portion can be squeezed together such that the area of the slot is decreased.

Embodiments may also provide a tool with elongated portions that include indented regions where a user can grasp and squeeze the elongated portions.

Embodiments may also provide a tool with elongated portions separated by a slot, where the slot includes at least one rounded slot region that is shaped to receive a cylindrical member.

Embodiments may also provide a tool with elongated portions separated by a slot, where the slot includes two or more rounded slot regions for receiving cylindrical members of different sizes.

Embodiments may also provide a tool with elongated portions separated by a slot, where the slot includes two or more polygonal slot regions for receiving parts of different sizes.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
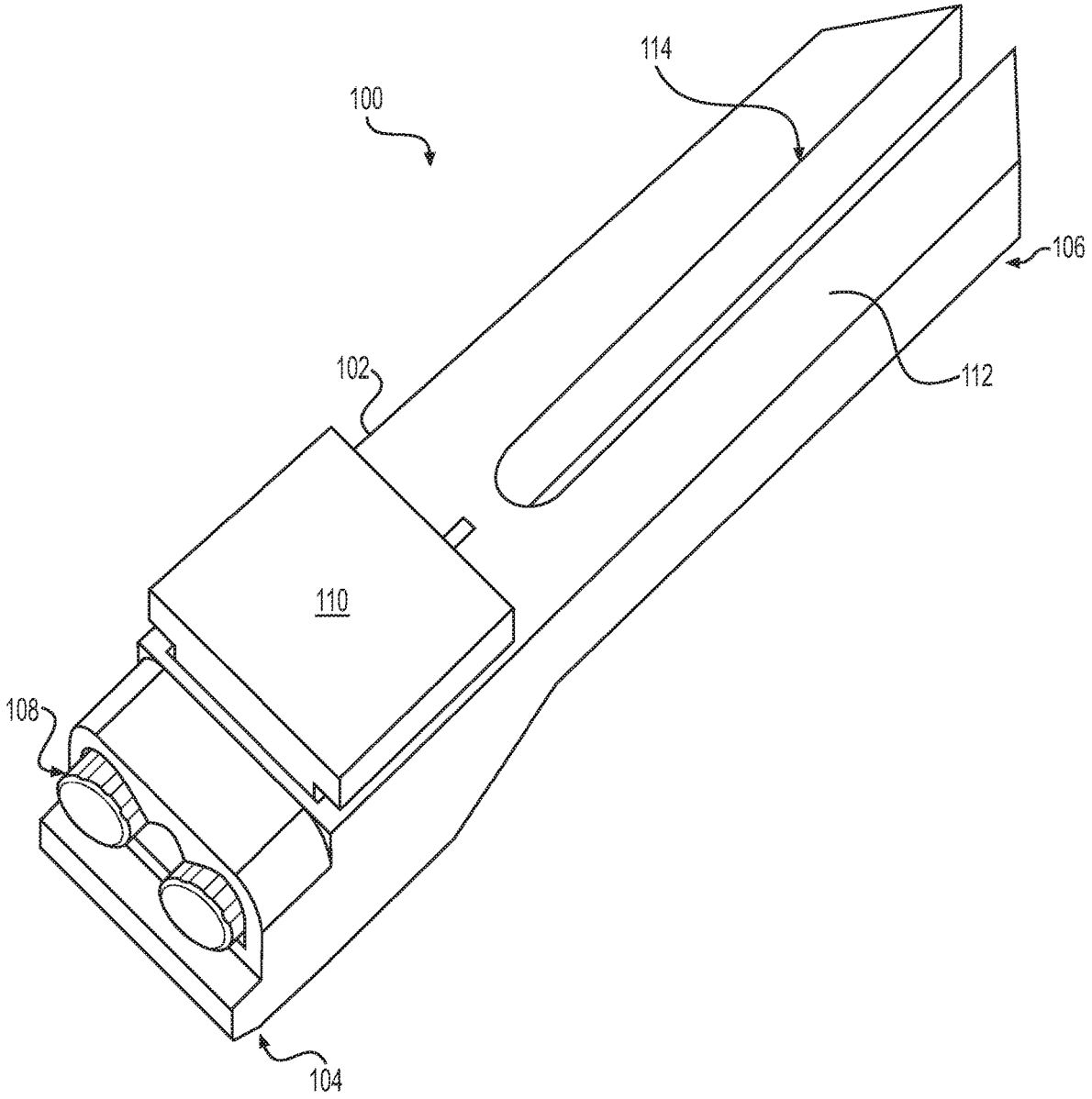
FIG. 1 is a schematic view of an embodiment of a tool for use with a toy construction set.

Embodiments provide a tool that can be used to separate blocks, rods, and other elements of a toy construction set from one another. Embodiments can include a coupling end with openings and moveable pegs that can be used to temporarily attach the tool with the corresponding pegs or openings of another block. Once attached to the block, the tool can be rotated or otherwise used as a lever to separate the block from other parts of a constructed assembly of blocks and other elements. The moveable pegs can then be retracted or extended to quickly "pop off" the detached block. Embodiments may also include an end with elongated portions that can be deformed to grasp, pinch, or clamp onto a rod or other part. Thus, the elongated portions may act as pliers that can grip the rod to allow a user to easily separate the rod from another block. Embodiments may also include projecting elements that can be used to push out rods or other elements from openings in another block or other element.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component.

The embodiments of a tool may be used with various pieces of a set of toy construction elements. Such a construction set may include various sized blocks as well as related parts that can be attached to the blocks and/or one another. These parts include various rods (e.g., x-shaped rods and cylindrical rods), bars, cylindrical sleeves, and other construction elements with various sizes and geometries.

As discussed in further detail below, embodiments of a tool can include one or more openings and/or pegs that may be coupled with corresponding pegs and/or openings on other blocks in a toy construction set. A tool may facilitate the separation of blocks or other elements.

In general, toy construction blocks are well known in the art and come in various sizes and shapes. The blocks are often rectangular in shape and have upwardly projecting pegs on their top surface arranged in a matrix, and means on their bottom surface for releasably interlocking one of these blocks on top of another toy construction block or other element. Many other shapes are possible. Using a plurality of these blocks, one may assemble various structures, such as houses, cars, and airplanes. These blocks are extremely versatile given the variety of shapes available and their easy interlocking mechanism. Exemplary construction blocks that may be used with a tool are MEGA BLOKS MICROBLOKS produced by MEGA BRANDS of Montreal, Canada. Other examples of toy construction blocks that could be used with a tool are disclosed in U.S. Pat. No. 5,827,106, issued Oct. 27, 1998, and U.S. Pat. No. 5,779,515, issued Jul. 14, 1998, both of which are herein incorporated by reference in their entirety.

A block may comprise pegs that are arranged in a particular array or matrix, which may correspond to the approximate geometry of the block. As used herein, the term 'geometry' generally refers to the shape and/or relative arrangement of the parts of something. Each array may be characterized by a number of rows of pegs and the number of pegs within each row (e.g., rows and columns of pegs). As an example, a block may be configured as a 2×4 array, with pegs approximately equally spaced in 2 rows of 4 pegs each. Alternatively, a block could be configured in any other kind of array, including 1×2, 1×3, 1×4, 2×2, 2×3, 2×4, 3×3, 3×4, as well as any other arrays of pegs.

In some embodiments, a block may be provided with a plurality of openings for receiving complementary-shaped construction toy elements. As with the pegs on top of a block, the opening regions (or simply openings) on the lower side of a block may also be configured in arrays (i.e., a 2×4 array of openings). Examples of blocks with openings for receiving construction toy elements are disclosed in U.S. Pat. No. 7,666,054, issued Feb. 23, 2010, which is herein incorporated by reference in its entirety.

FIGS. 1-39 illustrate various embodiments of a tool for use with various toy construction sets. In some cases, a tool may include provisions for removing or detaching a block, a rod, or another part from a constructed assembly (i.e., an assembly made of multiple blocks, rods, or other parts).

FIG. 1 is a schematic view of an embodiment of a tool 100. Tool 100 may be comprised of a body 102. Body 102 may include a first end portion 104 and a second end portion 106. In some embodiments, first end portion 104 may include a block-coupling end, or simply a coupling end. The coupling end of a tool may be configured to couple with pegs or openings in a block or other part. Alternatively, first end portion 104 may be referred to as a block-engaging end (or just engaging end), since first end portion 104 may be adapted to couple with pegs or openings in a block or similar part. For coupling one or more blocks, first end portion 104 may be configured with one or more openings (or holes) and/or one or more pegs. In one embodiment, first end portion 104 may include a set of peg-like structures 108 that protrude along first end portion 104. These peg-like structures 108 may be configured to insert into openings in another block (i.e., openings that may be disposed along the bottom side of a block) as discussed in further detail below. In some embodiments, first end portion 104 may also include one or more openings to receive pegs of another block (i.e., pegs disposed on the top side of a block) as also discussed in further detail below.

In some embodiments, a tool may also include one or more moving members or features. The term 'moving member' as used throughout this detailed description and in the claims refers to any member, component, or part that can slide, move, or translate with respect to another member, component, or part. In some embodiments, a moving member may be attached to, and can move with respect to, a body of the tool.

In some embodiments, tool 100 includes a moving member 110 that can slide along or relative to a portion of body 102. In some cases, peg-like structures 108 may be attached and/or integrally formed with moving member 110 such that as moving member 110 is moved, peg-like structures 108 may be retracted within, or extended outside of, openings within first end portion 104. Further details of another exemplary configuration of a moving member with retractable elements are discussed below with respect to the embodiment shown, for example, in FIGS. 8-9.

In some embodiments, second end portion 106 of body 102 is comprised of two elongated members 112 that are separated by a slot 114. This configuration allows second end portion 106 to act as pliers that can grasp elements of a constructed assembly, such as rods.

Figure 3:
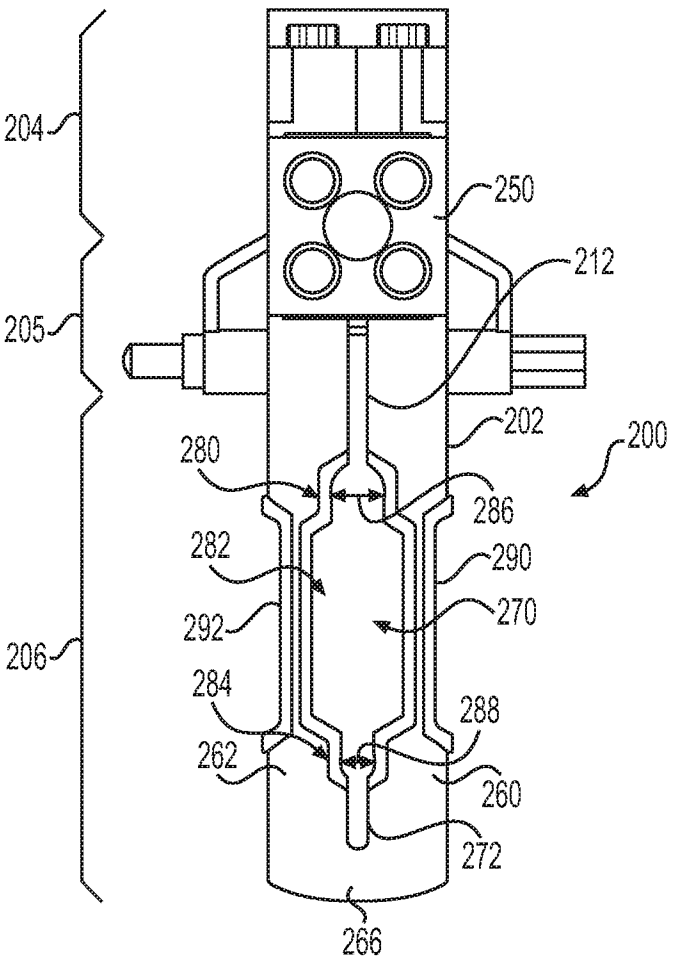
FIG. 3 is a schematic top view of the tool of FIG. 2.
Figure 2:
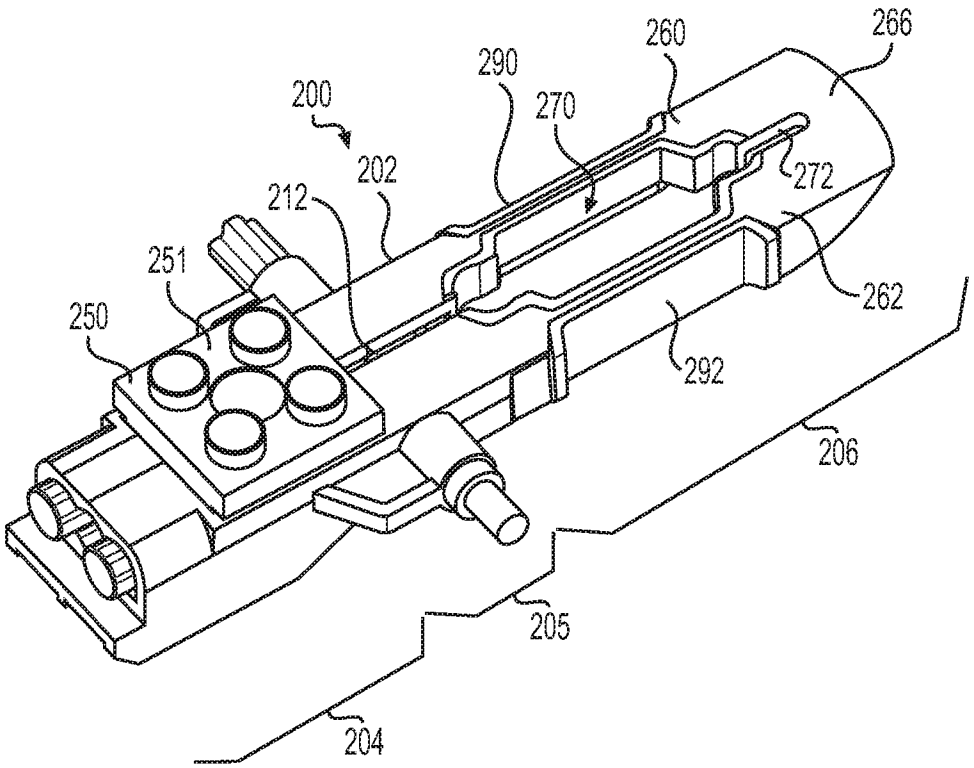
FIG. 2 is a schematic view of another embodiment of a tool for use with a toy construction set.

FIGS. 2-3 are schematic views of another embodiment of a tool 200. Tool 200 may be comprised of a body 202. Body 202 may include a first end portion 204, an intermediate portion 205, and a second end portion 206. In this exemplary embodiment, first end portion 204 serves as a block-coupling portion. Specifically, first end portion 204 may include provisions for attaching to a block in a constructed assembly so that the block can be removed. In this embodiment, second end portion 206 serves as a grasping end. Specifically, second end portion 206 may include elongated portions that can be squeezed together to grasp rods or other parts so that the parts can be easily separated from another component. In this embodiment, intermediate portion 205 may include provisions for removing rods, cylinders, or other parts from a constructed assembly. Specifically, intermediate portion 205 may include one or more projections that may be used to dislodge rods, cylinders, or other parts that are attached within corresponding openings of a block in a constructed assembly.

In some embodiments, tool 200 is configured as two separate parts that are assembled together. For example, tool 200 may be comprised of body 202 and a separate moving member 250.

Figure 5:
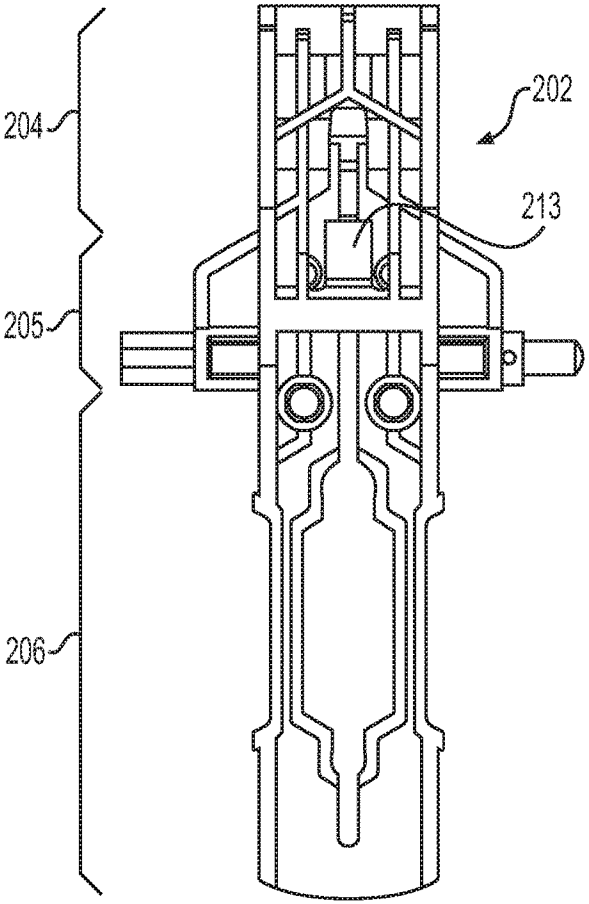
FIG. 5 is a schematic bottom view of the body of FIG. 4.
Figure 4:
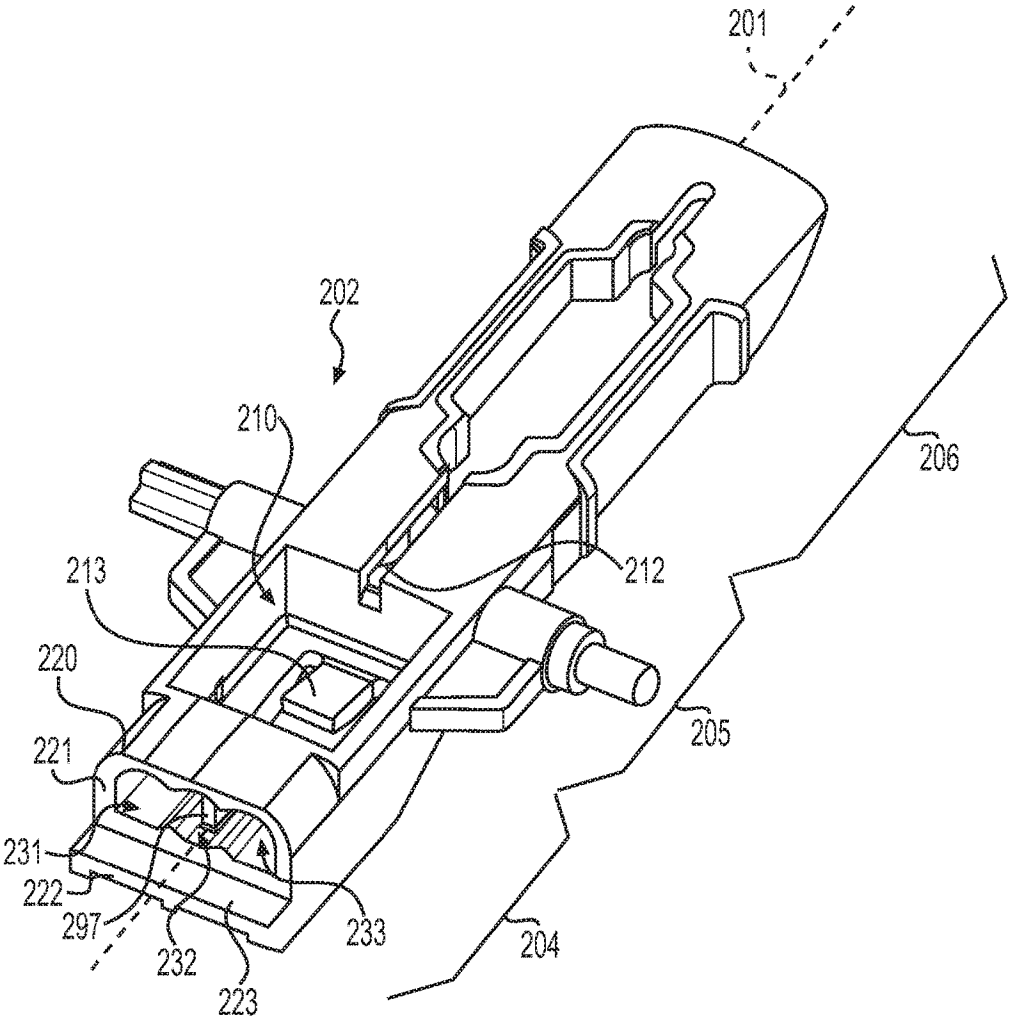
FIG. 4 is a schematic isometric view of an embodiment of a body of a tool.

As seen in FIGS. 4-5, which depict body 202 in isolation from moving member 250, body 202 extends from first end portion 204, through intermediate portion 205, and to second end portion 206. The various features and provisions of body 202, which are generally defined by the geometry of body 202 at various locations, will be discussed within the context of the main parts of tool 200. In some embodiments, body 202 could be a monolithic part (i.e., a single molded part). In other embodiments, however, body 202 could be comprised of separate parts that are attached using adhesives, mechanical connections, etc.

First end portion 204 of tool 200 may include provisions for engaging another block. First end portion 204 may also include provisions for popping the block off tool 200 once the block has been removed from the constructed assembly. This can be done for even, odd, and detrammeur blocks. As used herein, a 'detrammeur block' is a block that provides a peg or raised opening for holding beams, posts, or for connecting parts centrally on an even block (i.e., a central peg or raised opening that is centered along a 1×2 block).

In some cases, first end portion 204 may include a base coupling portion 220 and a tapered projecting portion 222. Tapered projecting portion 222 may be a blade-like portion that extends from base coupling portion 220. Moreover, tapered projecting portion 222 may extend in a direction parallel with a lengthwise direction (or, similarly, a longitudinal axis 201) of tool 200. As used herein, the lengthwise direction of tool 200 is a direction extending from second end portion 206 to first end portion 204 (or vice versa).

Base coupling portion 220 may present a first engagement surface 221 and tapered projecting portion 222 may present a second engagement surface 223. In some cases, first engagement surface 221 may face in a lengthwise direction of tool 200. That is, the normal direction extending outwardly from first engagement surface 221 is parallel with a longitudinal axis of tool 200. In some cases, second engagement surface 223 may be approximately perpendicular to first engagement surface 221. In use, base coupling portion 220 may be disposed against one surface of a block (i.e., a top or bottom surface) while tapered projecting portion 222 may extend against a perpendicular surface (i.e., a side of the block).

In some embodiments, first engagement surface 221 may include one or more openings. As shown in FIG. 4, in one embodiment first engagement surface 221 includes a first opening 231, a second opening 232, and a third opening 233. In some cases, these openings may have overlapping boundaries. This three-opening configuration may allow first engagement surface 221 to receive pegs from a corresponding block with two adjacent pegs (within first opening 231 and third opening 233). This configuration may also allow first engagement surface 221 to receive a single peg from a block with one centered peg (within second opening 232). In other embodiments, an engagement surface could include one, two, four, or more openings.

In some embodiments, tapered projecting portion 222 may have a tapered geometry that narrows in thickness from a portion directly adjacent base coupling portion 220 to a narrowest portion that is at the forward most edge of body 202. In some cases, this tapered geometry helps to ensure tapered projecting portion 222 does not interfere with any pegs adjacent the region where tool 200 is applied. In particular, tapered projecting portion 222 may be shaped and sized to ensure that it does not substantially enlarge the cross-sectional footprint of the coupling end of tool 200.

Body 202 may include provisions for receiving moving member 250 along parts of first end portion 204 as well as along parts of intermediate portion 205. In some cases, body 202 may include internal cavity 210 that receives some portions of moving member 250. In some cases, body 202 may also include a slot 212 that extends from internal cavity 210 towards second end portion 206. Both internal cavity 210 and slot 212 may facilitate the movement of moving member 250 along body 202, as discussed in detail below.

Figure 7:
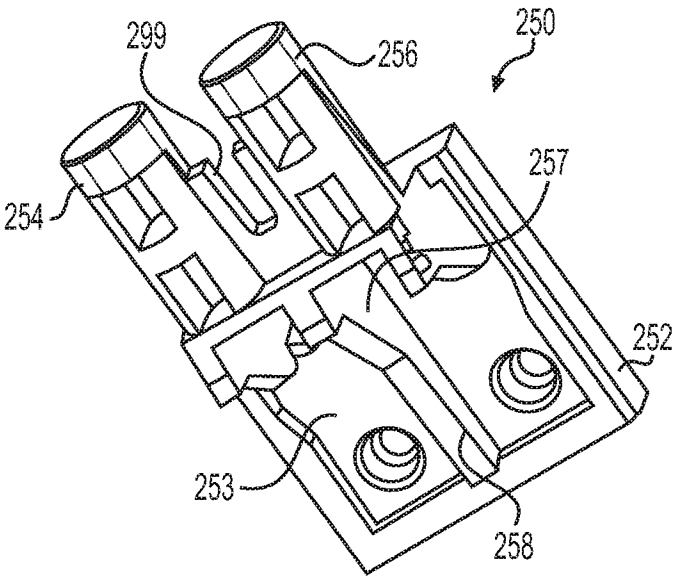
FIG. 7 is another schematic view of an embodiment of a moving member for a tool.
Figure 6:
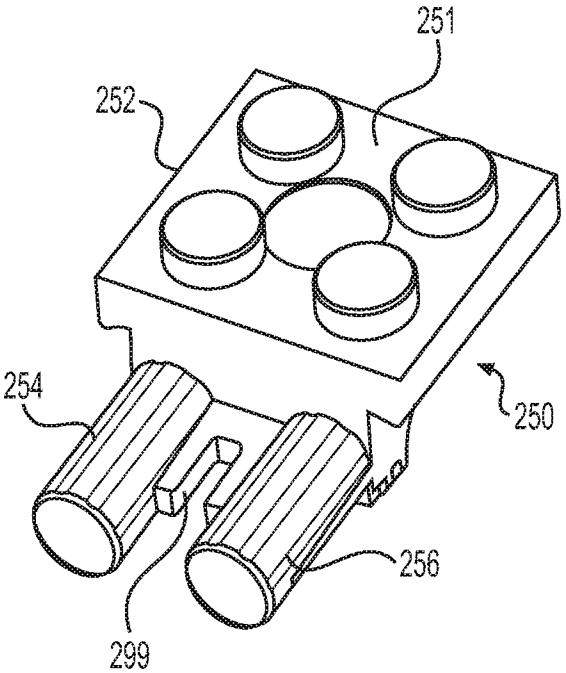
FIG. 6 is a schematic view of an embodiment of a moving member for a tool.

FIGS. 6-7 illustrate isometric views of an embodiment of a moving member 250 in isolation from body 202. Moving member 250 may comprise a base portion 252. Base portion 252 may include a top surface 251 and a bottom surface 253. Top surface 251 may be exposed on an outer side of tool 200 when moving member 250 is assembled with body 202 (see, e.g., FIG. 2). In this way, base portion 252 may be directly actuated by a user, for example, by pressing a finger onto base portion 252 and sliding it forward or rearward (i.e., toward either of first end portion 204 or second end portion 206) within body 202.

Moving member 250 may also include one or more pegs, or peg-like projections. In one embodiment, moving member 250 may include first peg 254 and second peg 256. First peg 254 and second peg 256 may extend in an approximately perpendicular direction from top surface 251 of base portion 252. This orientation allows first peg 254 and second peg 256 to be actuated in a lengthwise direction as moving member 250 is translated along the length of body 202.

In some embodiments, a moving member can include provisions that restrict its motion. In one embodiment, best shown in FIG. 7, moving member 250 may include a ramp 257 and a rib 258. Rib 258 may fit within slot 212 (see FIG. 4) to guide the movement of moving member 250 along a linear path. In addition, ramp 257 may interact with a corresponding tab 213 (see FIGS. 4-5) of body 202. In some cases, tab 213 may act as a stop to moving member 250 as ramp 257 comes into contact with tab 213. This feature may prevent moving member 250 from sliding too far along body 202 to the point where the pegs may fall out of the openings in the coupling end.

In different embodiments, a tab and corresponding ramp could provide various kinds of functionality. In some cases, a tab and a ramp may be designed to lock together and temporarily hold a moving member in place with respect to a body until sufficient force is supplied by a user to unlock them (or until the user depresses the tab from the underside of tool 200). In other embodiments, however, a ramp may simply contact a tab without locking, thereby functioning as a stop for moving member 250. In some embodiments, a tab may be used to help separate a moving member from a body. For example, in some cases tab 213 may be depressed so that moving member 250 can slide into a position where moving member 250 can be separated from body 202.

In some cases, moving member 250 may include a slot 299 disposed between first peg 254 and second peg 256 that may be configured to engage stop 297 (see FIG. 4) in body 202. This configuration may help limit the degree to which first peg 254 and second peg 256 can extend out of opening 231 and opening 233 (see FIG. 4).

In some embodiments, moving member 250 can include provisions for retaining a construction block temporarily. For example, if a user wishes to take a break while constructing an assembly of blocks, it may be desirable to make the "next block" that the user intends to add to a constructed assembly easily identifiable. In some embodiments, moving member 250 may include one or more pegs that can be used to hold the next block for easy identification. Thus, a user takes the block to be added next in a construction sequence and attaches the block to moving member 250 while the user takes a break from construction. When the user resumes construction at a later time, the user can easily identify which block the user intends to add next to the assembly (and thus, where the user left off in the construction process).

In different embodiments, the number and/or arrangement of pegs could vary. In one embodiment, moving member 250 may include a 2×2 array of pegs, but in other embodiments any other array could be used. Moreover, in still other embodiments, the body of a tool could include one or more pegs for storing/identifying other blocks.

When moving member 250 is assembled with body 202 (as shown for example, in FIGS. 8-9), first peg 254 and second peg 256 may be partially disposed within internal cavity 210. Moreover, first peg 254 may be partially disposed within or through first opening 231 and second peg 256 may be partially disposed within or through third opening 233. In addition, portions of rib 258 may be disposed in internal cavity 210 and other portions of rib may be disposed over and/or within slot 212.

In some embodiments, first end portion 204 may have a reconfigurable geometry, transitioning between at least two different configurations. In a first configuration, first end portion 204 may present openings that receive pegs from another block (e.g., the pegs on the upper side of many construction blocks). In a second configuration, first end portion 204 may present pegs or peg-like elements that can be inserted into openings, recesses, or other cavities in another block (e.g., the openings or recesses on the lower side of many construction blocks). Moreover, by providing a first end portion 204 that can be configured in different ways, tool 200 may be utilized to remove blocks from above or from below a constructed assembly, as further described below.

Figures 8, 9:
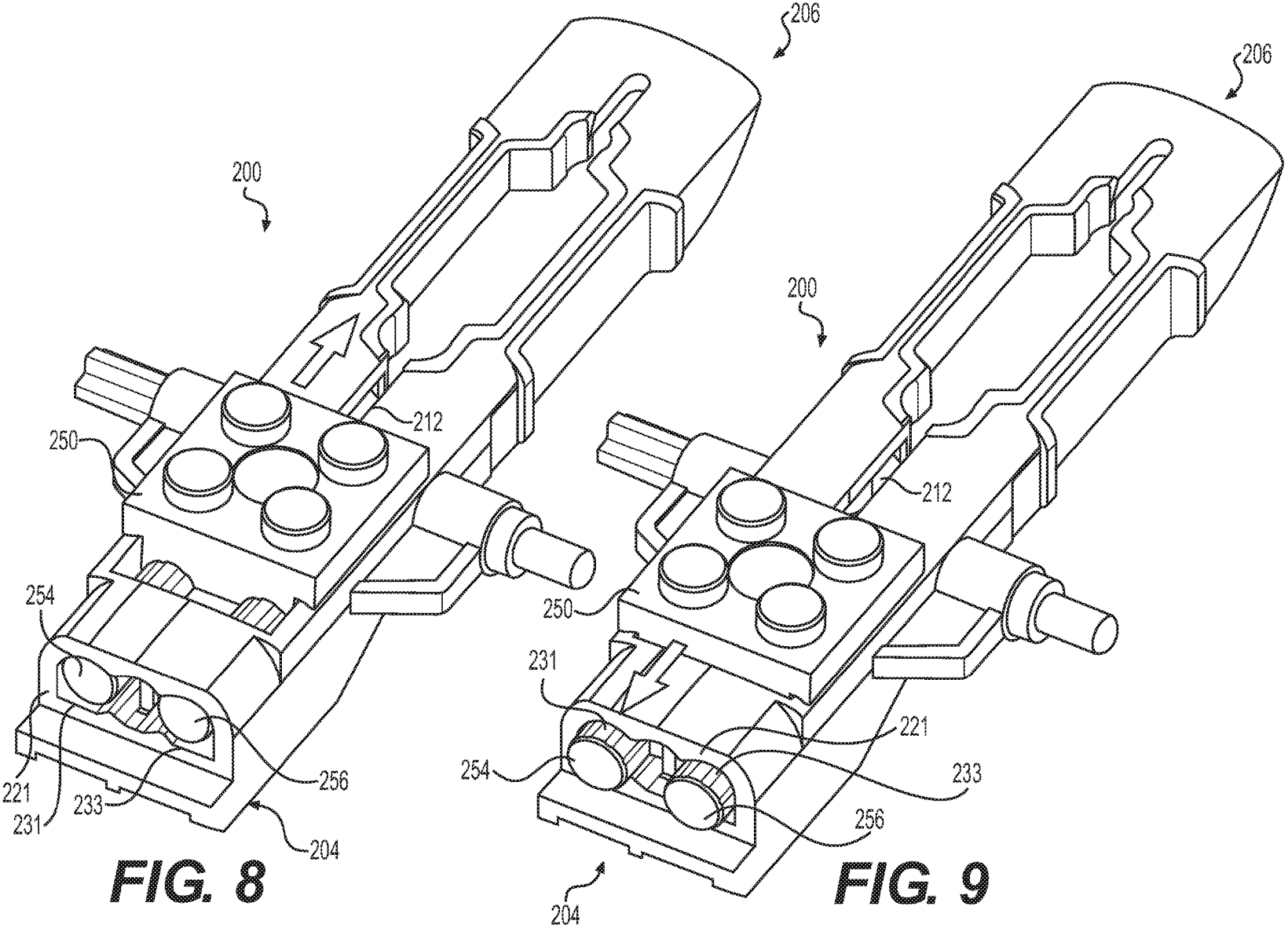
FIG. 8 is a schematic view of an embodiment of a tool in a first configuration.
FIG. 9 is a schematic view of the tool of FIG. 8 in a second configuration.

FIGS. 8-9 illustrate schematic isometric views of tool 200 in a first configuration (FIG. 8) and a second configuration (FIG. 9). In the first configuration, moving member 250 has been positioned closer to second end portion 206 with first peg 254 and second peg 256 partially retracted inwardly from engagement surface 221. In this configuration, first opening 231 and third opening 233 may be partially open (i.e., have a non-zero depth). In some cases, first opening 231 and third opening 233 may be open enough to receive corresponding pegs from a block.

In the second configuration, moving member 250 has been positioned closer to first end portion 204 (i.e., farther from second end portion 206) with first peg 254 and second peg 256 projecting outwardly from engagement surface 221. Moreover, first peg 254 and second peg 256 extend through the entire depth of first opening 231 and third opening 233. In some cases, first peg 254 and second peg 256 may project enough from first engagement surface 221 to be received by corresponding openings in a block. Thus, as tool 200 transitions between the first and second configurations, the geometry of first end portion 204 (i.e., the coupling end) changes.

Figure 11:
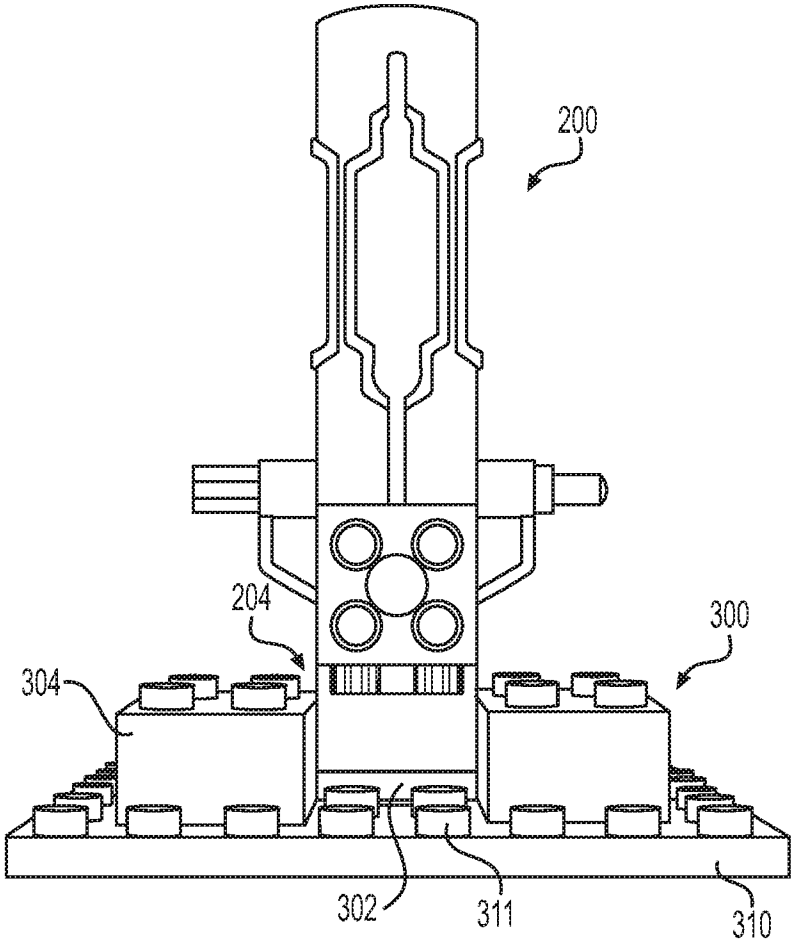
FIGS. 10-13 are schematic views of an embodiment of a tool being used to remove an even block from a top side of a constructed assembly of blocks.
Figure 10:
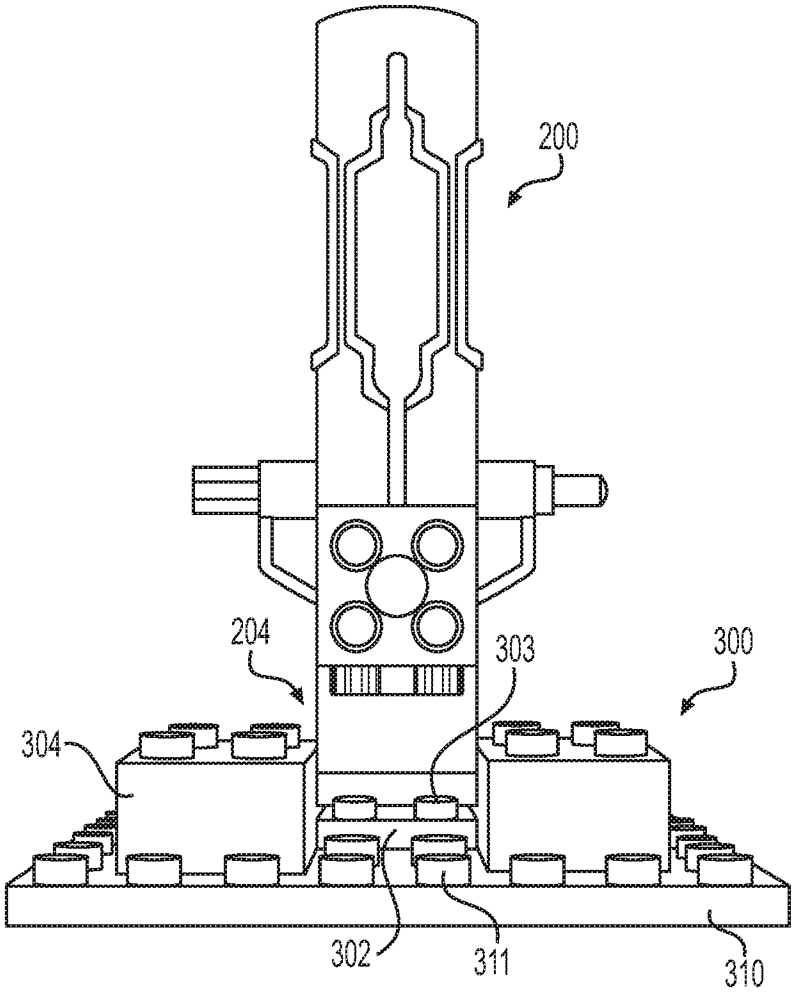
Figure 13:
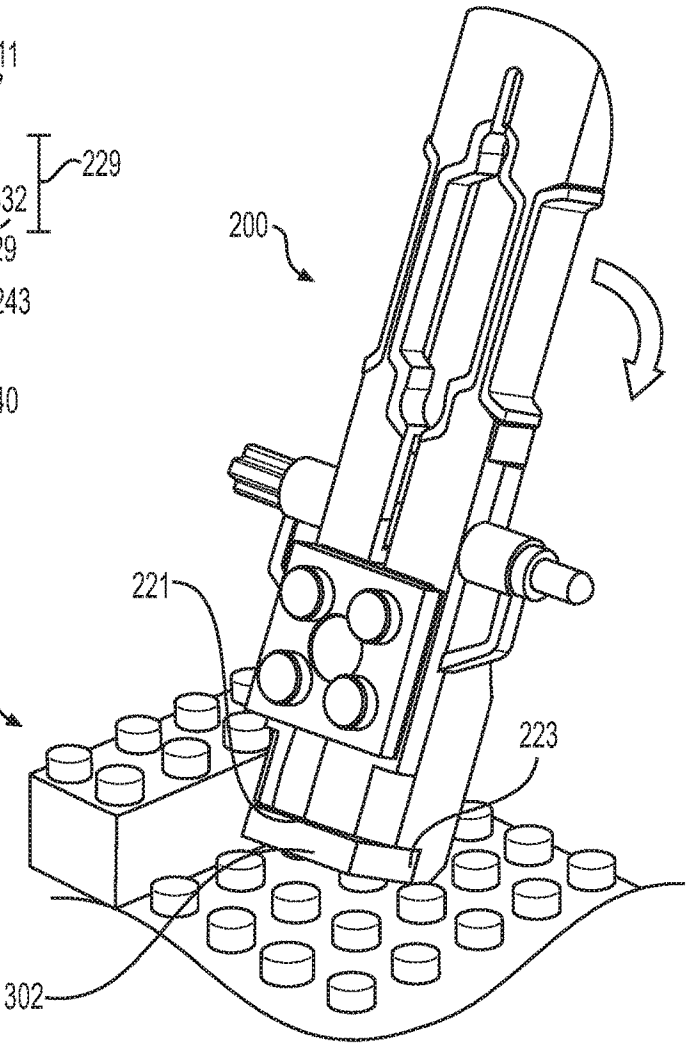
Figure 14:
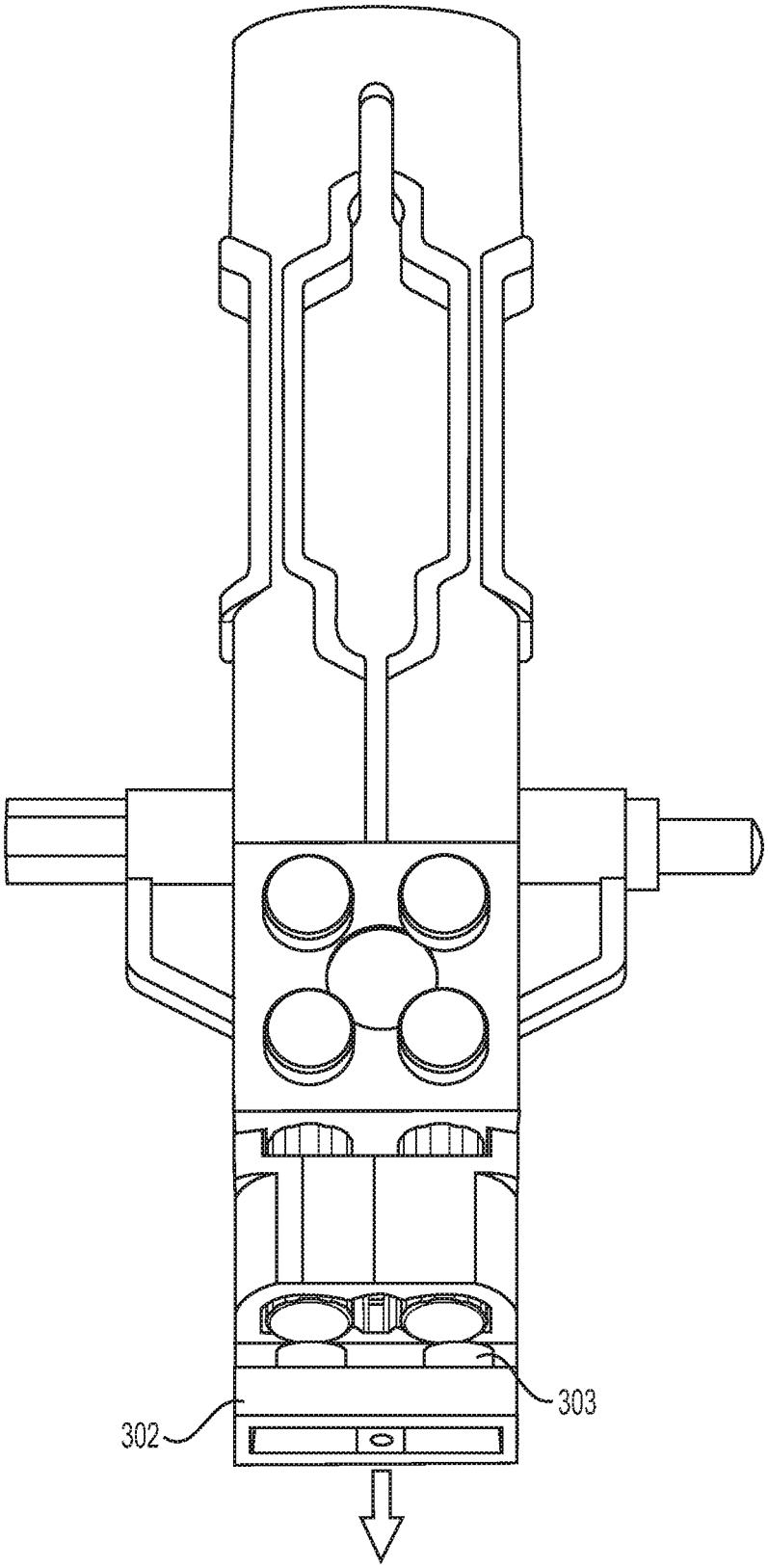
FIG. 14 is a schematic view of a step of actuating the tool of FIGS. 10-13 to pop off the even block.

FIGS. 10-14 show how tool 200 can be used to detach a block from the top side of a constructed assembly (FIGS. 10-13) and then easily pop off the detached block from tool 200 (FIG. 14). Starting in FIG. 10, tool 200 may be associated with a constructed assembly 300 in which a user desires to remove an even 1×2 block (i.e., block 302). Block 302 may be positioned between two 2×4 blocks (blocks 304) and attached to pegs 311 of a base piece 310. To remove block 302, first end portion 204 of tool 200 may be pushed down against block 302, as seen in FIG. 11. Specifically, pegs 303 of block 302 may be received within first opening 231 and third opening 233 (shown in FIG. 8) of base coupling portion 220. This may temporarily couple tool 200 and block 302.

Figure 12:
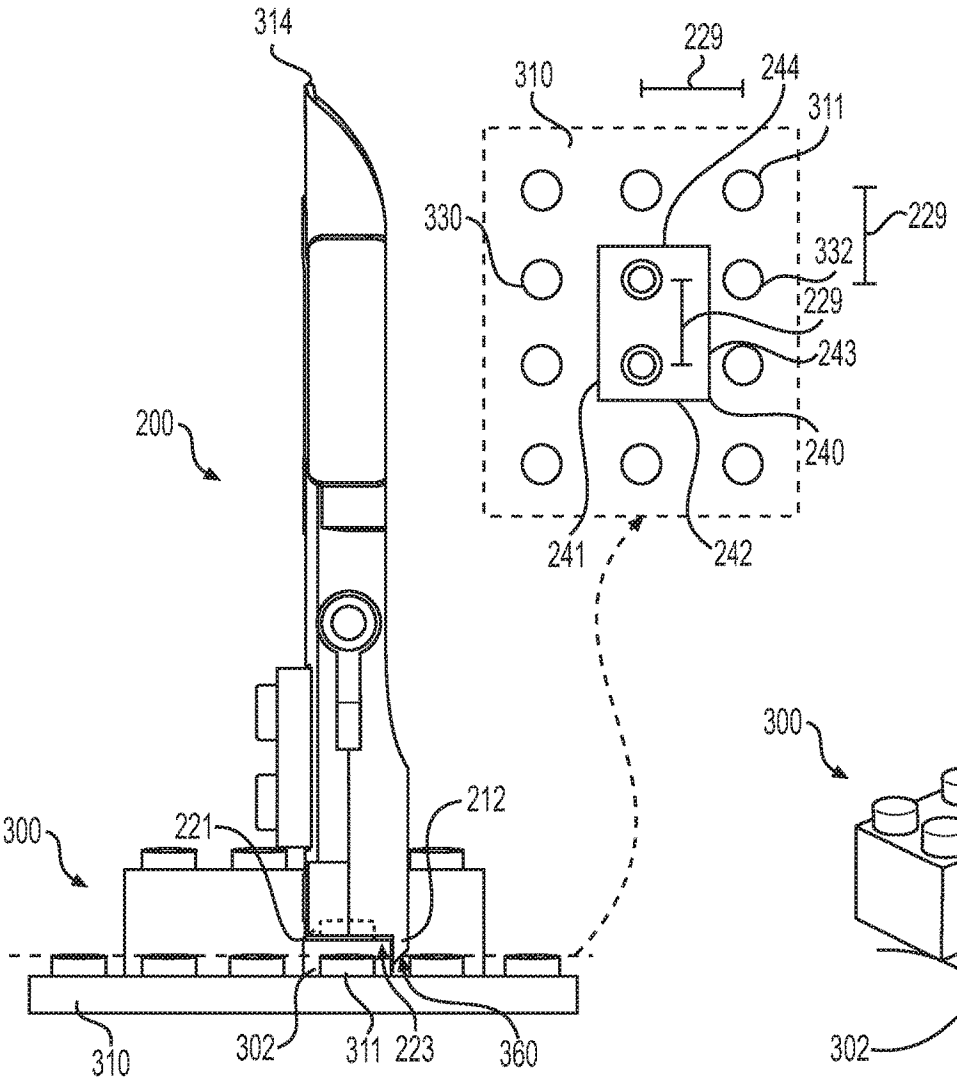

Referring to FIGS. 12 and 13, with first engagement surface 221 and second engagement surface 223 disposed against the top and side surfaces of block 302, tool 200 can be rotated to pry block 302 off pegs 311 of base piece 310.

Finally, once block 302 has been removed from the constructed assembly, it can be easily "popped off" of tool 200 by actuating moving member 250, as seen in FIG. 14. In particular, sliding moving member 250 into the second configuration (towards first end portion 204) extends first peg 254 and second peg 256, thereby pushing pegs 303 of block 302 out of first opening 231 and third opening 233.

The embodiments may be configured to ensure that the coupling end of the tool has sufficient clearance for engaging a block in a constructed assembly. To achieve this, the coupling end of a tool may have a sufficiently small horizontal footprint. Otherwise, the edges of the tool may overlap with adjacent pegs or other parts in a constructed assembly, which may limit the ability of the tool to engage with a target block for detachment.

For purposes of characterizing the horizontal footprint of a coupling end, FIG. 12 shows an enlarged cross-sectional view of tool 200 and parts of assembly 300. Referring to FIG. 12, the coupling end (first end portion 204) of tool 200 may include an outer perimeter 240. Outer perimeter 240 is the perimeter of first end portion 204 as taken through a plane perpendicular to the lengthwise axis of tool 200. Outer perimeter 240 is further comprised of a first perimeter edge 241, a second perimeter edge 242, a third perimeter edge 243, and a fourth perimeter edge 244, which together comprise the entirety of outer perimeter 240.

Because adjacent pegs on most elements in a toy construction set may be separated by a common uniform peg separation distance, it is desirable to ensure that no part of the coupling end of a tool extends farther from the center of either opening than this peg separation distance. In FIG. 12, a peg separation distance 229 is defined as the distance between the center of first opening 231 and the center of second opening 232. Peg separation distance 229 may, in many cases, be equal to the uniform peg separation distance between adjacent pegs on many other elements of a construction assembly.

As seen in FIG. 12, the present embodiment is characterized by the fact that none of the edges (i.e., first perimeter edge 241, second perimeter edge 242, third perimeter edge 243, and fourth perimeter edge 244) of outer perimeter 240 lies farther than the peg separation distance 229 from opening 231 or from opening 233. That is, each edge is within the peg separation distance of at least one of opening 231 or opening 233. This configuration may ensure that the horizontal footprint of the coupling end of tool 200 will not overlap with the adjacent pegs on base piece 310. It is also apparent from FIG. 12 that tapered projecting portion 222 also lies within the peg separation distance 229 from at least one of opening 231 or opening 233. That is, tapered projecting portion 222 does not increase the horizontal footprint of the coupling end to a point where it would interfere with adjacent pegs on another block.

When tool 200 is placed in position to engage with block 302, the horizontal footprint of first end portion 204 fits between both forward adjacent peg 330 and rearward adjacent peg 332. If any portions of the coupling end extended as far as forward adjacent peg 330 or rearward adjacent peg 332, tool 200 would be prevented from fully engaging block 302 and would limit the ability of tool 200 to detach block 302.

It may also be noted that tapered projecting portion 222 may be shaped to facilitate prying off a block. As seen in FIG. 12, tapered projecting portion 222 may have a straight engagement surface 223 to receive a sidewall of block 302. Tapered projecting portion 222 may also have a tapered or concave rearward surface 360 that tapers to the farthest end of tapered projecting portion 222. At its widest location, tapered projecting portion 222 may be thin enough to fit with the peg separation distance 229 from adjacent pegs on base piece 310. Additionally, the tapered geometry of tapered projecting portion 222 may facilitate the prying off of block 302 since as tool 200 is rotated downward, the coupling end of tool 200 may smoothly rock on rearward surface 360.

Figure 16:
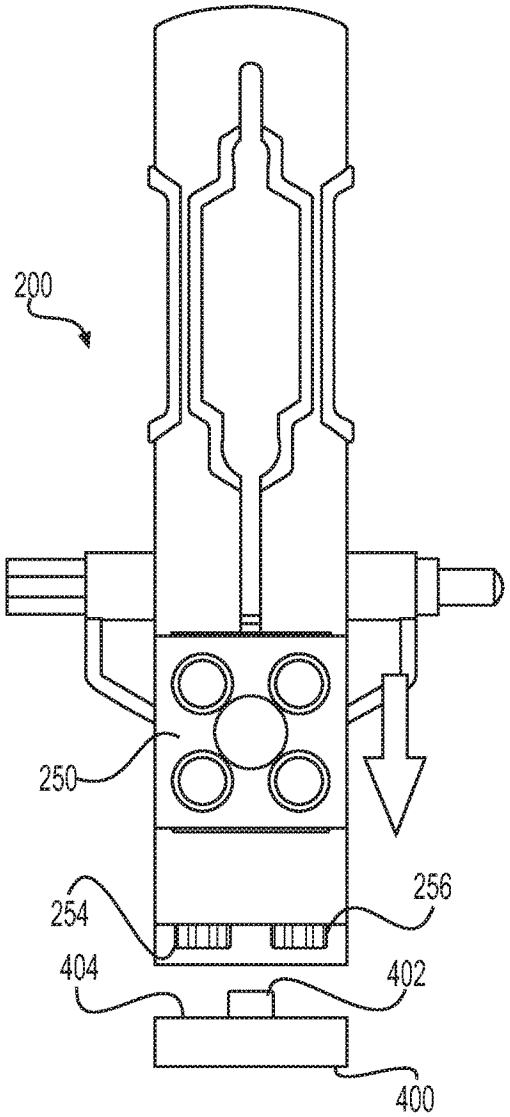
FIG. 16 is a schematic view of a step of actuating the tool of FIG. 15 to pop off the block.
Figure 15:
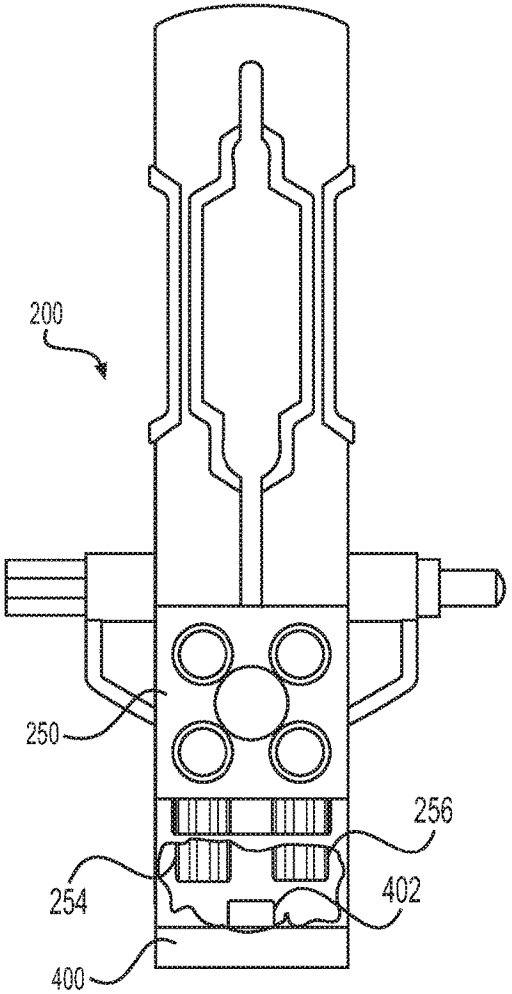
FIG. 15 is a schematic view of an embodiment of a tool being used to remove a block with a single centrally located peg, which shows a partial cutaway view of one end.
Figure 18:
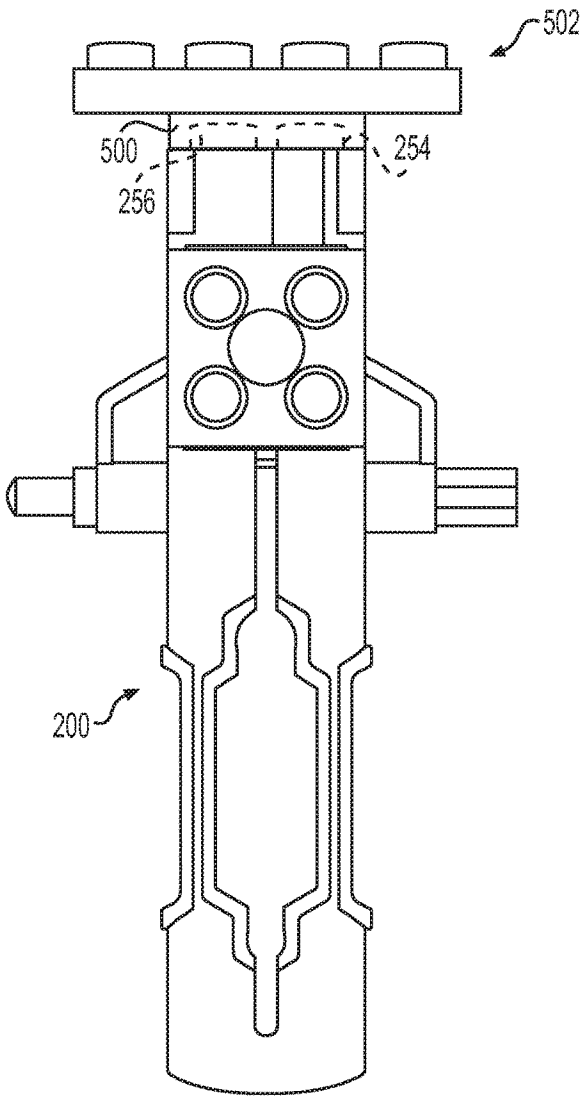
FIGS. 17-20 are schematic views of an embodiment of a tool being used to remove an even block from a bottom side of a constructed assembly of blocks.
Figure 17:
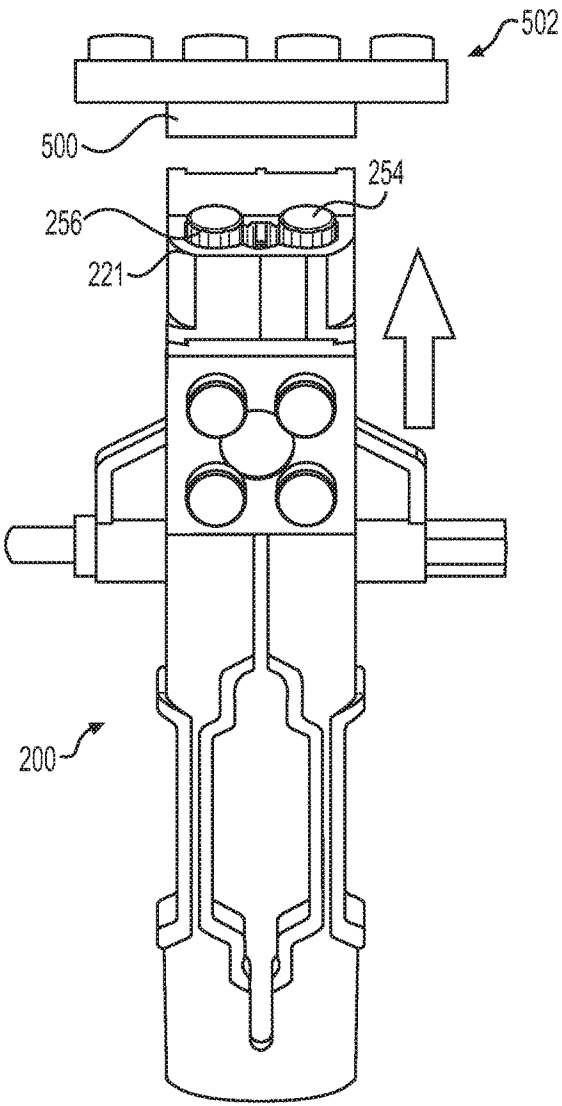

FIG. 15 illustrates a schematic view of a tool 200 including a partial cutaway view of first end portion 204. Referring to FIG. 15, a block 400 with a single centrally located peg 402 is attached to a base coupling portion 220 of the tool 200. For example, tool 200 may have been used to remove the block 400 from a toy construction set. In this case, peg 402 may have been retained within the central second opening 232 of tool 200 during removal of block 400 from a constructed assembly (the relative positions of peg 402, peg 254, and peg 256 are shown in the cutaway section of tool 200). FIG. 16 illustrates a schematic view of the tool 200 with the block 400 removed from the base coupling portion 220 of the tool 200. The block 400 can be removed by actuating moving member 250 while the block 400 is attached to the tool 200. Here, the pegs of moving member 250 do not directly push on peg 402 of block 400, but push instead against the top surface 404 of block 400 until peg 402 has been extracted from second opening 232.

Figure 21:
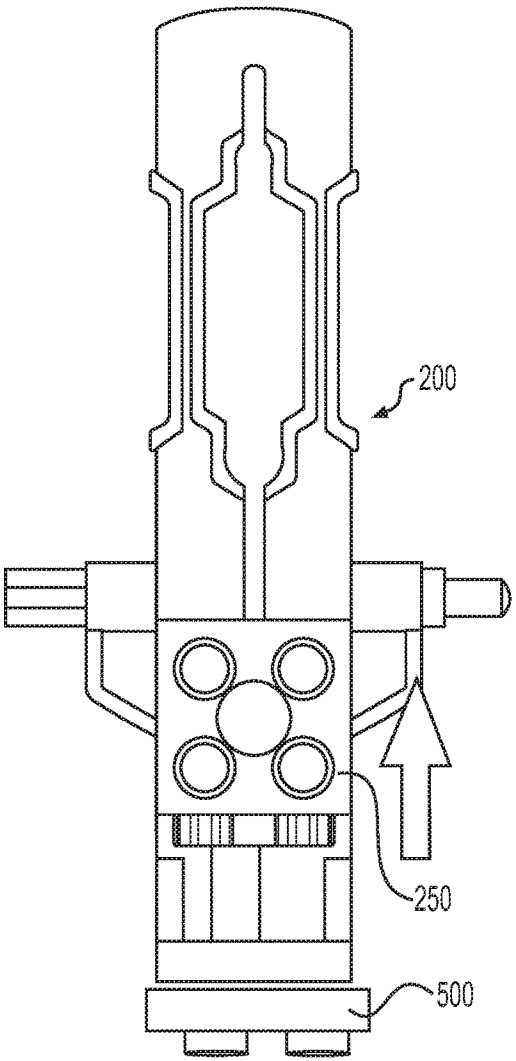
FIG. 21 is a schematic view of a step of actuating the tool of FIGS. 17-20 to pop off the even block.
Figure 20:
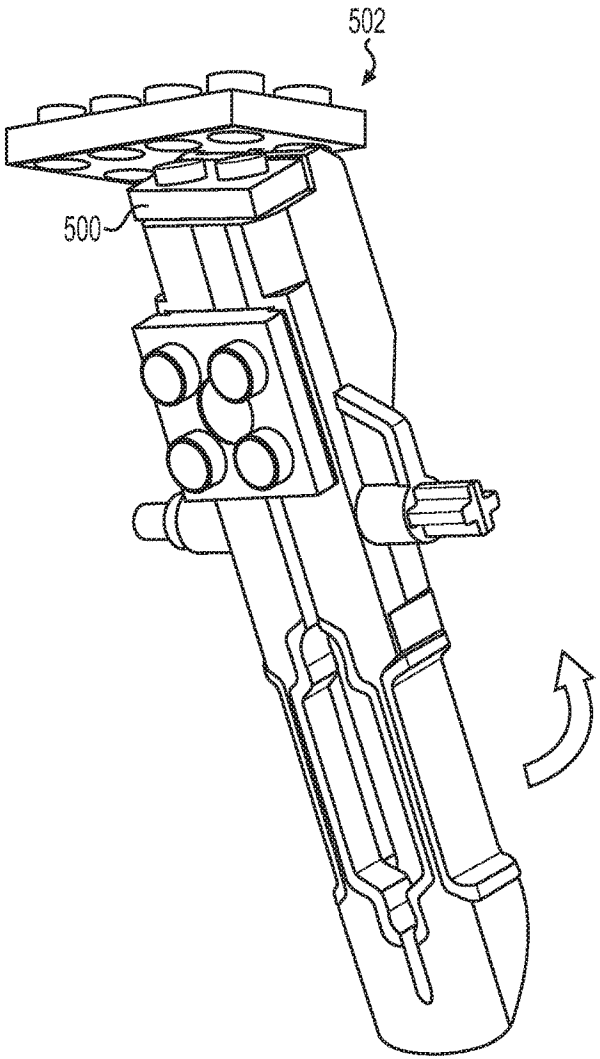
Figure 19:
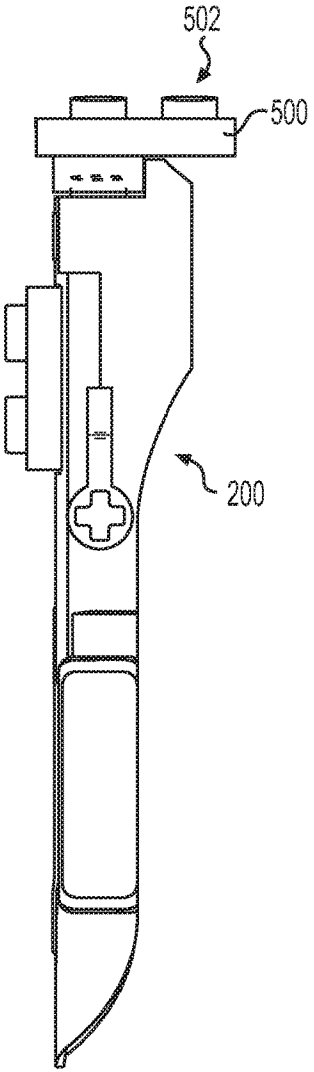

As previously discussed, first end portion 204 can also be used to remove blocks from the bottom side of a constructed assembly. FIGS. 17-21 show how tool 200 can be used to detach a block 500 from the bottom side of a construction assembly 502 (FIGS. 17-20) and then easily pop off the detached block from tool 200 (FIG. 21). This sequence may be performed similarly to the sequence described above for removing a block from the top side of an assembly. In contrast to the previous discussion, however, tool 200 should be actuated so that first peg 254 and second peg 256 are extended outwardly from engagement surface 221 to engage with openings on the lower side of block 500. This may be achieved by actively maintaining moving member 250 in the second (extended) configuration as tool 200 is attached to block 500. In some cases, following this initial attachment, an interference fit between first peg 254, second peg 256, and openings in block 500 may be sufficient to maintain moving member 250 in the extending position. When block 500 has been removed it may be "popped off" by actuating moving member 250 into the first (retracted) configuration, since removing the pegs from the openings of block 500 will cause block 500 to "fall off" of tool 200.

Figure 23:
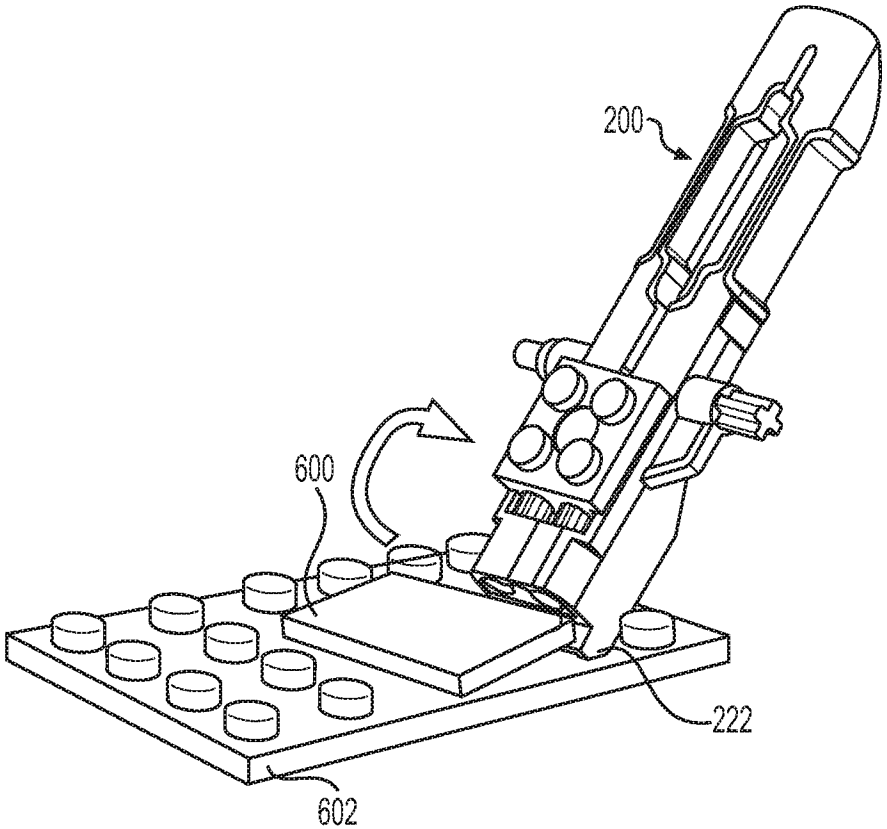
FIGS. 22-23 are schematic views of an embodiment of a tool being used to pry off a planar block that lacks pegs from an underlying part.
Figure 22:
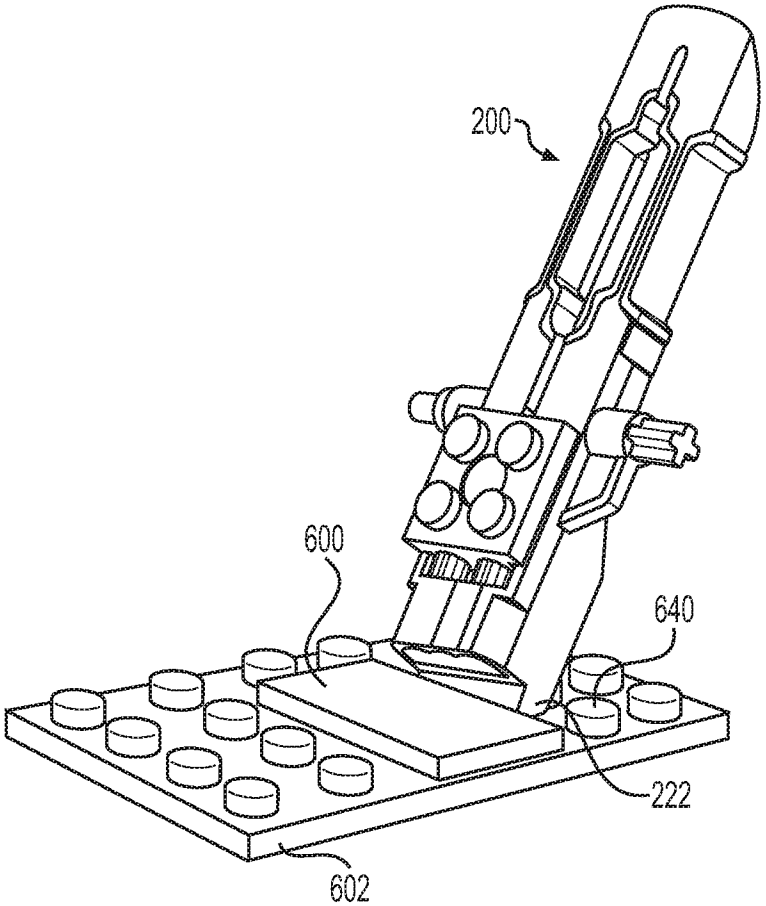

In some embodiments, tapered projecting portion 222 may be used to pry off blocks that lack pegs or openings on an exposed surface. For example, FIGS. 22-23 illustrate schematic views of a sequence of removing a flat paneled block 600 from a base element 602. This may be done by positioning tapered projecting portion 222 against the lower edge of block 600 (FIG. 22), or a corner of a lower edge of block 600, and then rotating second end portion 206 of tool 200 downward so as to pry block 600 from base element 602 (FIG. 23). As previously discussed, the narrow width and tapered geometry of tapered projecting portion 222 may help tapered projecting portion 222 fit between block 600 and the adjacent row of pegs 640.

In another embodiment, a tool could include other provisions for prying a block up by engaging the blocks corner. As an example, the embodiment of FIGS. 38-39 includes elongated portions 1204 with a set of opposing flanges 338. Flanges 338 extend from the edge of elongated portions 1204 and may be inserted between two blocks at the corner of the two blocks to help pry them apart. In still other embodiments, similar actions of prying a block by engaging the corner or edge of the block can be done with a tapered or blade-like rearward edge 341 on second end portion 206 (see FIG. 12, which best shows the tapered geometry of second end portion 206 that includes a blade-like edge). In other embodiments, similar prying actions could be accomplished using tapered projecting portion 222 on first end portion 204.

Figures 24, 25, 26, 27:
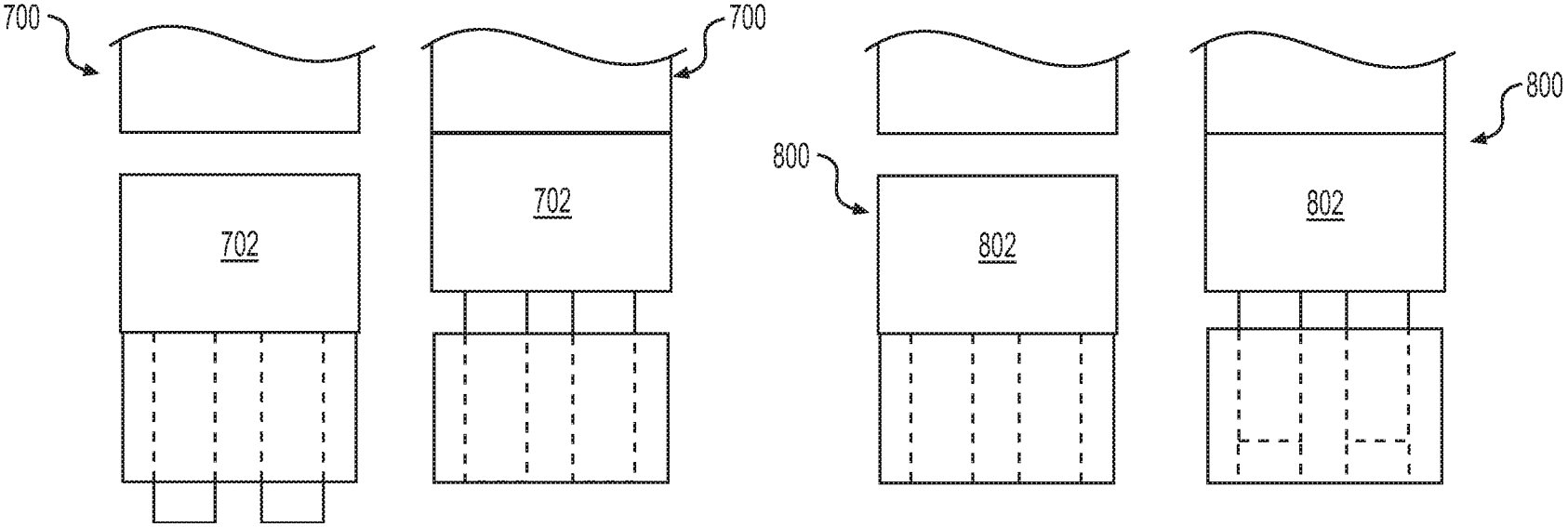
FIGS. 24-25 are schematic views of another embodiment of a coupling end of a tool in two different configurations.
FIGS. 26-27 are schematic views of another embodiment of a coupling end of a tool in two different configurations.

It may be appreciated that in some other embodiments a tool may be configured for use only on blocks attached at the bottom of an assembly, or only on blocks attached at the top of an assembly. For example, FIGS. 24-25 show an exemplary embodiment of the coupling end of a tool 700 in which moving member 702 is restricted to move between a first extended configuration (FIG. 24) and a second partially retracted configuration (FIG. 25). In the partially contracted configuration of FIG. 25, the pegs of moving member 702 do not recede into the openings and so tool 700 may not receive pegs in other blocks. Thus, this arrangement may limit tool 700 to use with blocks on the bottom side of an assembly.

FIGS. 26 and 27 show an exemplary embodiment of a tool 800 in which moving member 802 is restricted to move between a first partially extended configuration (FIG. 26) and a second fully retracted configuration (FIG. 27). In the partially extended configuration of FIG. 26, the pegs of moving member 802 do not extend outward of the openings, and so cannot be inserted into openings in other blocks. Thus, this arrangement may limit tool 800 to use with blocks on the top side of an assembly.

As previously discussed, a tool can include provisions for grasping rods, tubes, and any other elongated parts that a user may desire to remove from a constructed assembly. In some embodiments, a tool may include elongated portions that can be squeezed together in order to help grasp various rods and other parts.

Referring back to FIGS. 2-3, tool 200 may include a second end portion 206 that may facilitate grasping, holding, pinching, or similar activities. In some embodiments, second end portion 206 may be comprised of a first elongated portion 260 and a second elongated portion 262, which extend from intermediate portion 205 to the rearward edge of tool 200.

In contrast to the embodiment shown in FIG. 1, first elongated portion 260 and second elongated portion 262 may not be completely separated at their farthest ends, but may be attached by a connecting portion 266. Instead, first elongated portion 260 and second elongated portion 262 may be separated along much of their length by a large central slot 270 and a smaller end slot 272 adjacent connecting portion 266. In addition, large central slot 270 may extend continuously with slot 212 that extends to internal cavity 210.

As best seen in FIG. 3, large central slot 270 may be comprised of a first rounded slot region 280, a wide slot region 282 and a second rounded slot region 284. As discussed in further detail below, first rounded slot region 280 and second rounded slot region 284 may be configured to grasp and retain various sized rods, cylinders, or other elongated parts when second end portion 206 is squeezed. Although some embodiments may use rounded slot regions for grasping parts, in other embodiments, a slot region could be polygonal in shape (i.e., comprised of connected straight edges) or any other shape suitable for grasping.

First rounded slot region 280 may have a first width 286 and second rounded slot region 284 may have a second width 288 that is less than first width 286. This difference in widths may allow the different rounded slot regions to better grasp and hold different sized rods, as discussed below.

First elongated portion 260 and second elongated portion 262 may also be configured with outer indentations. For example, first elongated portion 260 may have a first outer indentation 290 and second elongated portion 262 may have a second outer indentation 292. These outer indentations may provide a region for a user's fingers to easily grasp and squeeze second end portion 206. These outer indentations may also provide regions of reduced thickness on the elongated portions, thereby making it easier for the elongated portions to flex as the user squeezes them together. Although the embodiment of FIG. 3 illustrates indentations 290, 292 each with one large outwardly facing surface and two opposing angled surfaces, many other shapes and sizes are possible, while still providing grasping regions and regions of reduced thickness.

In some cases, the presence of smaller end slot 272 as well as slot 212 may also contribute to the extent to which second end portion 206 can deform under a squeezing force.

Figure 29:
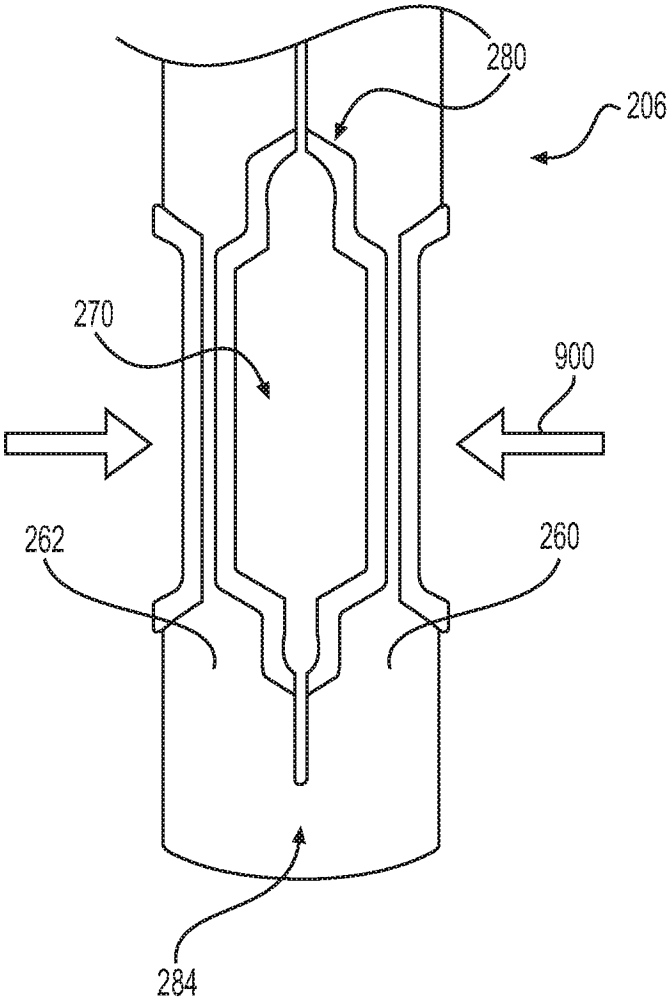
FIGS. 28-29 are schematic views of an embodiment of a second end portion of a tool that is configured to deform.
Figure 28:
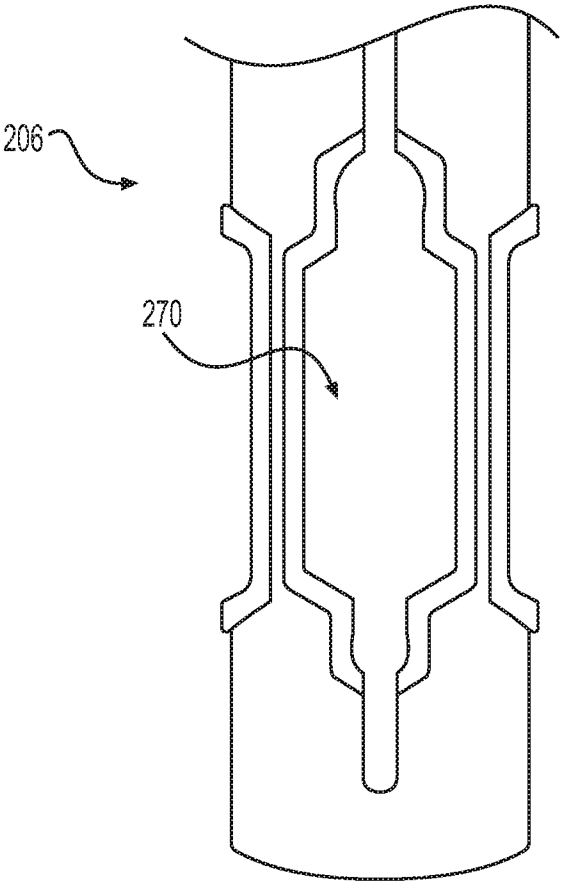

FIGS. 28 and 29 illustrate schematic views of second end portion 206 in a non-deformed state (FIG. 28) and a deformed state (FIG. 29). In the non-deformed state, large central slot 270 has a first cross-sectional area. However, as a squeezing force 900 is applied by a user, first elongated portion 260 and second elongated portion 262 may deform inwardly, resulting in a second cross-sectional area for large central slot 270. This second cross-sectional area is smaller than first cross-sectional area 902. Moreover, as the cross-sectional area of large central slot 270 is reduced, the widths of first rounded slot region 280 and second rounded slot region 284 are also reduced. As the widths of the rounded slot regions are reduced, they may apply an inward grasping or clamping force to any objects (i.e., rods) that are positioned within them as second end portion 206 is squeezed.

Figure 39:
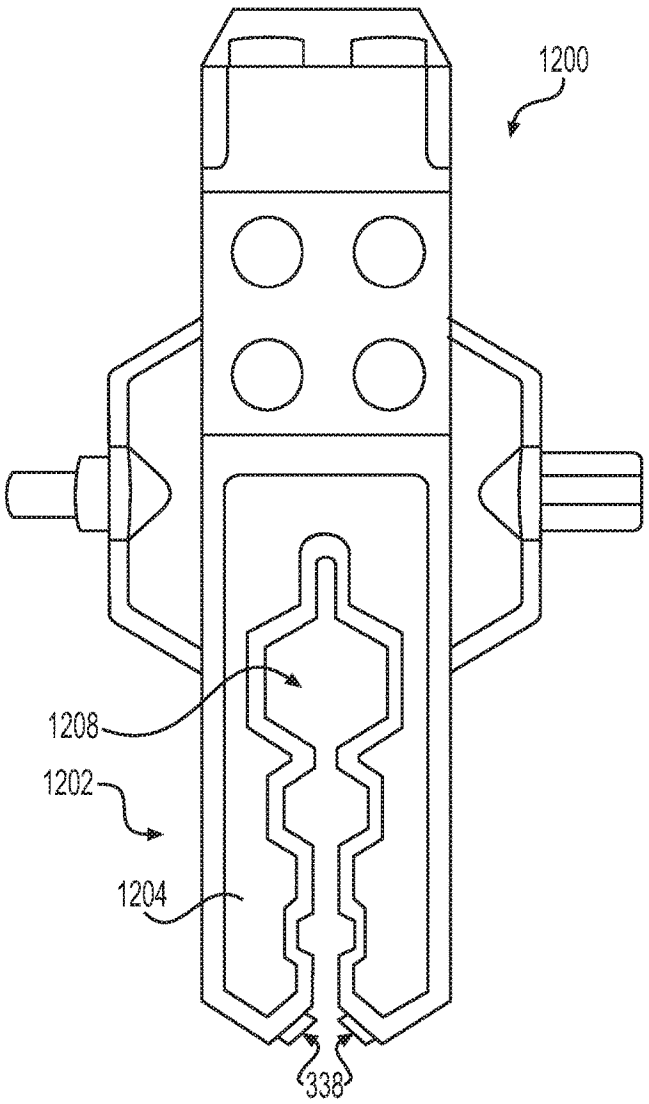
FIG. 39 is a schematic top view of the tool of FIG. 38.
Figure 38:
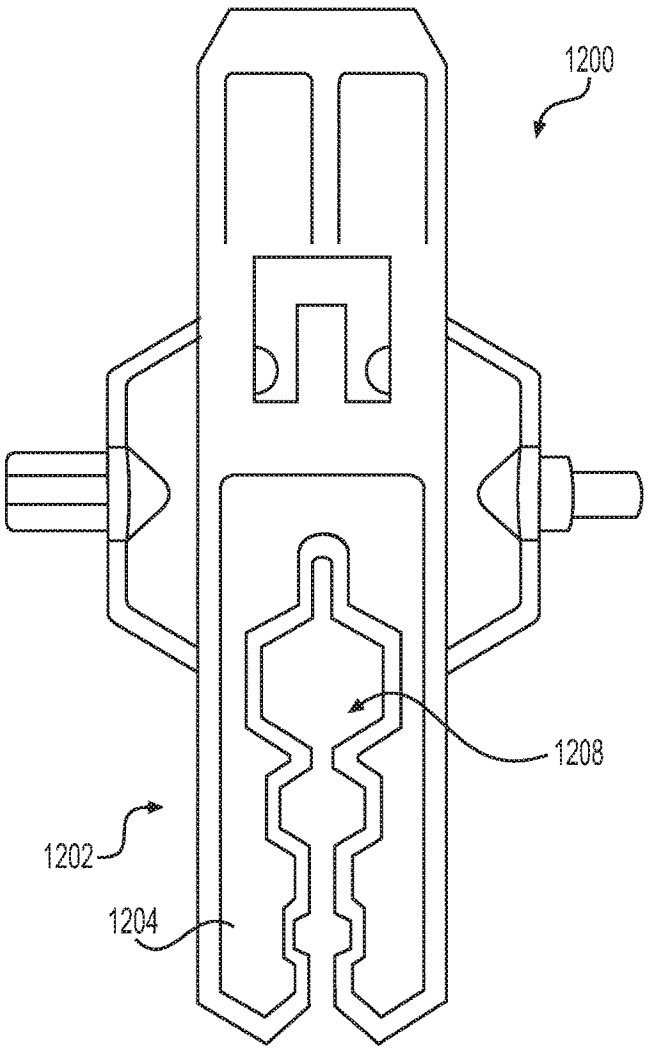
FIG. 38 is a schematic bottom view of another embodiment of a tool for use with a toy construction set.

It may be appreciated that the degree of flexibility of first elongated portion 260 and second elongated portion 262, and their ability to be moved inwardly towards one another, can be varied in other embodiments by changing various provisions such as the dimensions of one or more slots, the depth of indented regions, and/or the type of material used for making body 202. In other embodiments, therefore, the geometry of any elongated portions and/or the geometry of any slots could vary from the present embodiment. As an example, FIGS. 38-39 illustrate another embodiment of a tool 1200, which includes a grasping end having a different geometry. Specifically, grasping end 1202 of tool 1200 may be comprised of distinct elongated portions 1204 that are separated at their ends. Additionally, a slot 1206 separating the elongated portions 1204 may have a distinct geometry comprised of three hexagonal slot regions 1208 with descending widths. This design may allow tool 1200 to be used for grasping at least three different sized rods corresponding with the widths of the three rounded slot regions 1208.

Figure 31:
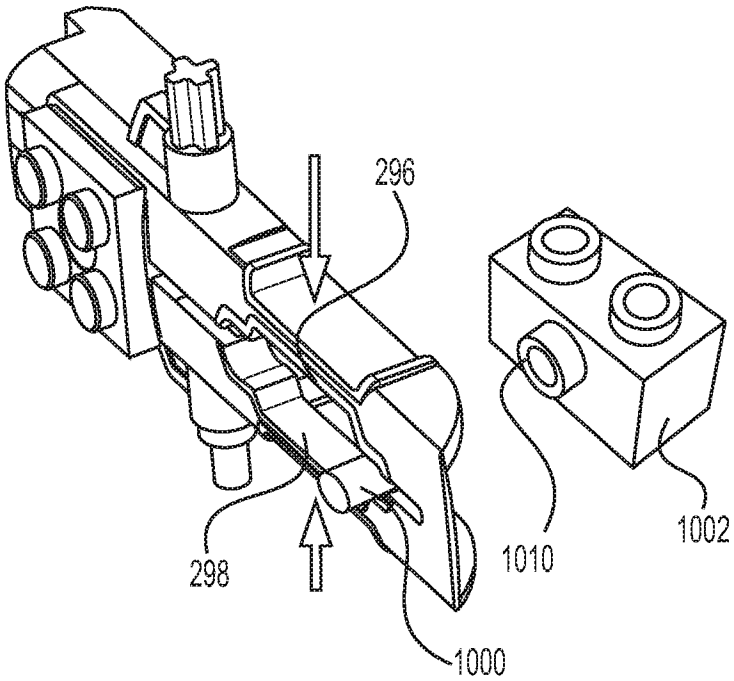
FIGS. 30-31 are schematic views of an embodiment of a tool being used to remove a rod.
Figure 30:
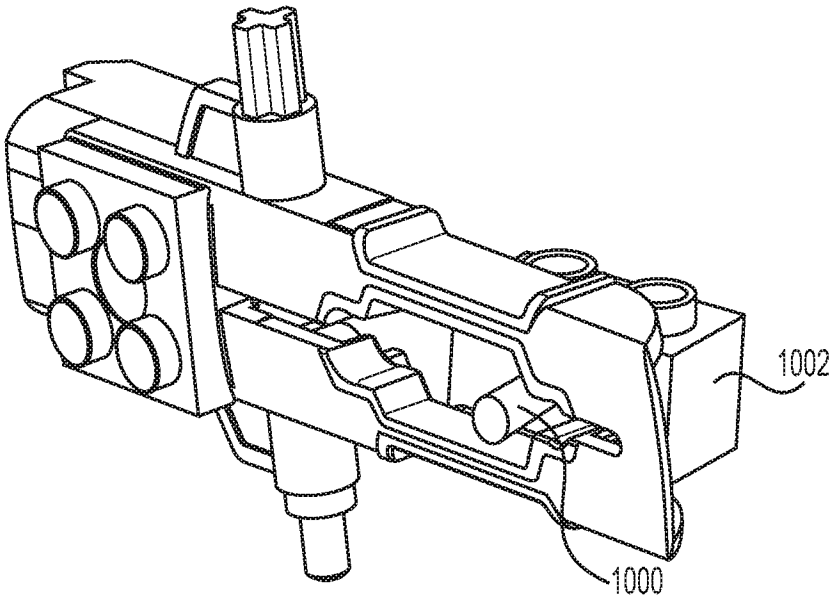

FIGS. 30-31 illustrate schematic views of tool 200 being used to remove a cylindrical rod 1000 from a block 1002. Second rounded slot region 284 is positioned around rod 1000, as seen in FIG. 30. Next, second end portion 206 is squeezed so that the width of second rounded slot region 284 is reduced. With sufficient squeezing force, second rounded slot region 284 may deform to the point where first inner surface 296 and second inner surface 298 of first elongated portion 260 and second elongated portion 262, respectively, may grasp rod 1000 with sufficient friction that rod 1000 can be pulled out of opening 1010 in block 1002. In some embodiments, to facilitate grasping a part, first inner surface 296 and/or second inner surface 298 could be coated or covered with a material that has a high coefficient of friction compared to the material comprising base portion 202. For example, in one embodiment, first inner surface 296 and/or second inner surface 298 could be coated with a rubber layer, thereby increasing traction between tool 200 and a corresponding part being grasped with second end portion 206. Additionally, in some cases, the outer surfaces of first outer indentation 290 and second outer indentation 292 could also be covered with rubber or another high friction material (relative to base portion 202) that may allow a user to better grip the tool during use. Alternatively, any of the inner or outer surfaces of the elongated portions could have a texture that improves friction/grip.

Figure 33:
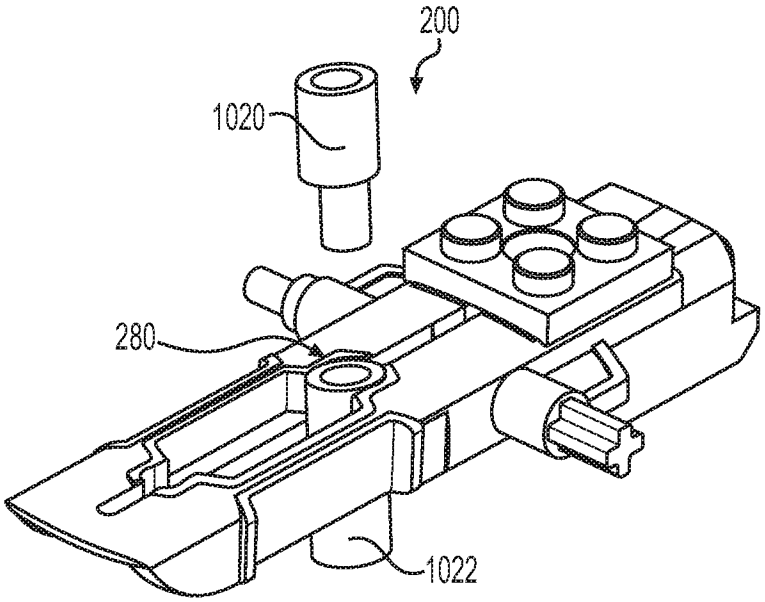
FIGS. 32-33 are schematic views of an embodiment of the tool of FIGS. 30-31 being used to remove a rod of a different size.
Figure 32:
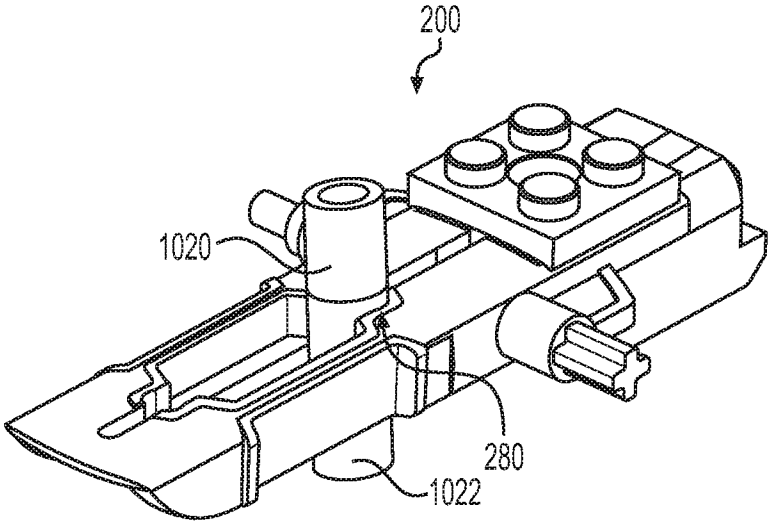
Figure 35:
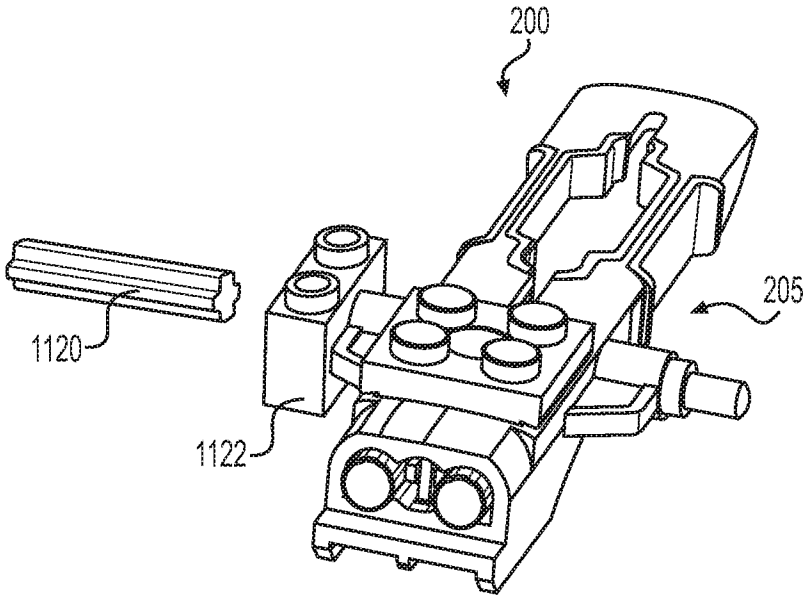
FIGS. 34-35 are schematic views of an embodiment of a tool being used to remove x-shaped rods from a block.
Figure 34:
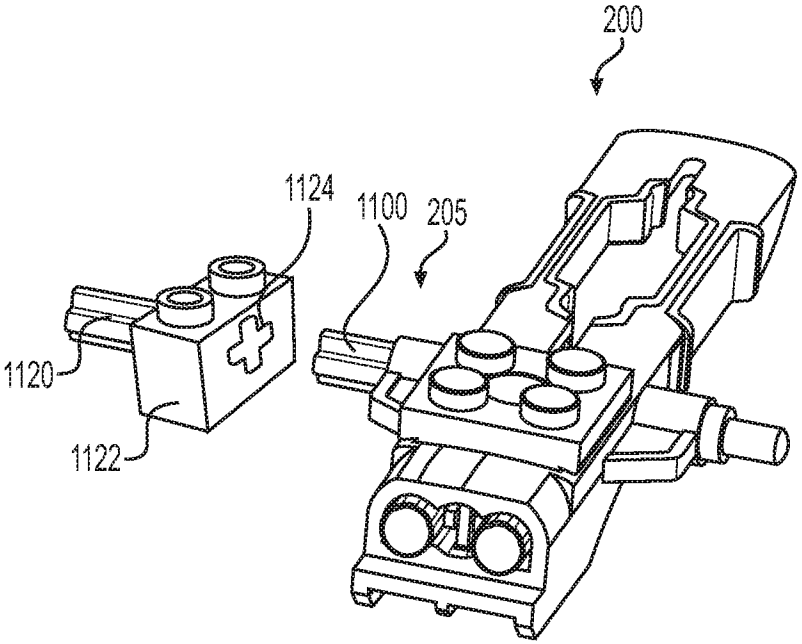

FIGS. 32 and 33 illustrate a similar process for separating a cylindrical insert 1020 from a cylindrical base 1022 using first rounded slot region 280.

Figure 36:
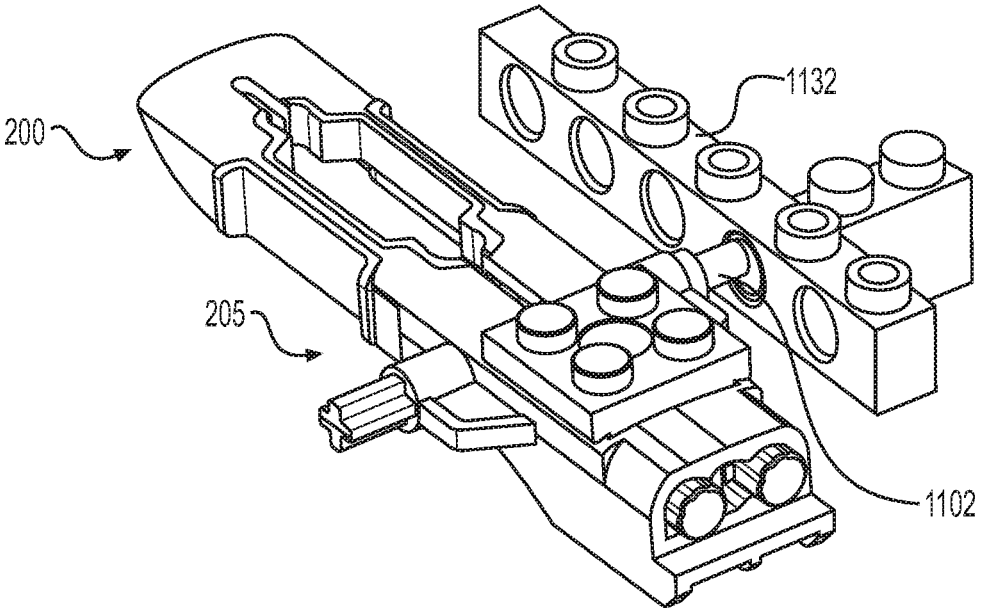
FIGS. 36-37 are schematic views of an embodiment of a tool being used to remove a cylindrical part from a block.
Figure 37:
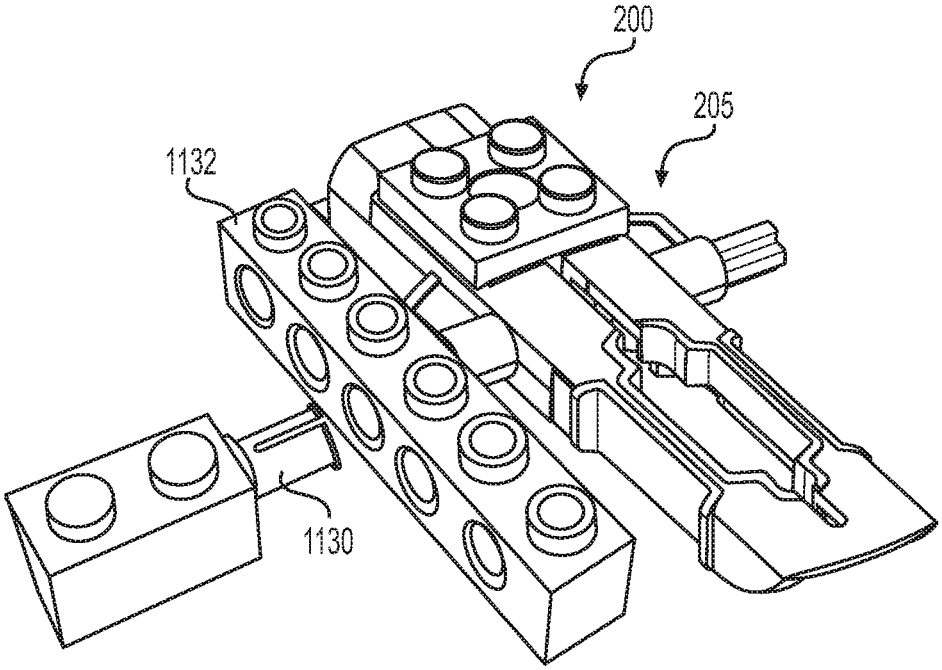

Some embodiments can also include provisions for dislodging rods or other elongated parts from blocks. In some embodiments, tool 200 may include projecting elements that extend out from body 202. Such projecting elements can be inserted into through-holes in a block that already retain a rod, sleeve or other part. For example, in FIGS. 34 and 35, a projecting element 1100 that extends from intermediate portion 205 can be used to dislodge an x-shaped rod 1120 from block 1122. In this case, projecting element 1100 also has an x-shaped geometry that conforms to the shape and size of the x-shaped opening 1124 in block 1122. In other embodiments, projecting element 1100 may have a different geometry and still be able to dislodge an x-shaped rod. In FIGS. 36-37, a projecting element 1102, which may be cylindrically shaped, may extend from intermediate portion 205 (on an opposing side from projecting element 1100), and may be used to dislodge a cylindrical part 1130 from block 1132. In other embodiments, projecting element 1102 may have a different geometry and still be able to dislodge a cylindrical part. While FIGS. 36-37 show projecting element 1102 being used to remove a micro-axis element (part 1130), in other embodiments projecting element 1102 could also be used to remove a rod or other element from an opening in a block.

The various embodiments can be constructed using a variety of different materials. Exemplary materials that could be used for making a body and/or a moving member for a tool include, but are not limited to, various kinds of plastics, metals, or other materials. In some embodiments, one or more parts of a tool may be constructed from acrylonitrile butadiene styrene (ABS). In other embodiments, one or more parts of a tool may be constructed from blends of ABS with other materials, such as polycarbonate/acrylonitrile butadiene styrene (PC/ABS). In embodiments, a single tool may be made of different materials at different regions and/or parts of the tool, as appropriate for the region or part. For example, referring to FIG. 1, a relatively hard and durable material could be used for a moving member 110 and/or for a first end portion 104, which may allow for better connections to and prying of other blocks, while a more flexible material could be used for a second end portion 106, which may allow for more movement and may resist breaking, in grasping another construction element.

The foregoing disclosure of the embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A tool for use with a set of toy construction elements, comprising:

a body, the body defining a lengthwise direction, the body including a coupling end with an engagement surface, wherein the tool has a first configuration and a second configuration, wherein in the first configuration the engagement surface presents at least one peg, wherein in the second configuration the engagement surface presents at least one opening, wherein a geometry of the coupling end changes as the tool transitions from the first configuration to the second configuration, and wherein the coupling end includes a tapered projecting portion that extends in the lengthwise direction and that is configured to contact a side of a block in the set of toy construction elements when the coupling end engages the block.

2. The tool according to claim 1, wherein in the first configuration the at least one peg is configured to be inserted into a corresponding opening of a block in the set of toy construction elements.

3. The tool according to claim 1, wherein in the first configuration the engagement surface presents two pegs.

4. The tool according to claim 3, wherein in the first configuration the two pegs are configured to be inserted into two corresponding openings of a block in the set of toy construction elements.

5. The tool according to claim 1, wherein in the second configuration the at least one opening is configured to receive a corresponding peg of a block in the set of toy construction elements.

6. The tool according to claim 1, wherein in the second configuration the engagement surface presents two openings.

7. The tool according to claim 1, wherein a normal direction extending outwardly from the engagement surface of the coupling end is parallel with the lengthwise direction.

8. The tool according to claim 1, wherein the body has an elongated geometry, and wherein the elongated geometry provides leverage for separating one block from another in the set of toy construction elements.

9. The tool according to claim 7, wherein in the second configuration the at least one opening is recessed within the engagement surface of the coupling end and comprises two outer openings continuous with and adjacent to a center opening between the two outer openings, wherein the two outer openings are configured to receive two pegs of the block separated by a peg separation distance when the coupling end engages the block, and wherein the center opening is configured to receive a single peg of a second block in the set of toy construction elements.

10. A tool for use with a set of toy construction elements, comprising:

a body and a moving member, the moving member including at least one peg, wherein the moving member has a contact surface configured to be contacted by a user for actuating the moving member, the body including a coupling end, the coupling end including at least one opening, the moving member being moveable along the body between a first position and a second position, and wherein as the moving member moves between the first position and the second position, the at least one peg moves through the at least one opening, wherein the coupling end includes three adjacent and continuous openings, and wherein the moving member includes two pegs corresponding to two of the three openings.

11. The tool according to claim 10, wherein in the first position the at least one peg projects outwardly from the at least one opening, and wherein in the second position the at least one peg is approximately flush with the at least one opening.

12. The tool according to claim 10, wherein in the first position the at least one peg is approximately flush with the at least one opening, and wherein in the second position the at least one peg is retracted within the at least one opening.

13. The tool according to claim 10, wherein in the first position the at least one peg projects outwardly from the at least one opening, and wherein in the second position the at least one peg is retracted within the at least one opening.

14. The tool according to claim 10, wherein the body defines a lengthwise direction, and wherein the coupling end includes a tapered projecting portion that extends in the lengthwise direction and that is configured to contact a side of a block in the set of toy construction elements when the coupling end engages the block.

15. The tool according to claim 14, wherein the three adjacent and continuous openings comprise two outer openings continuous with and adjacent to an intermediate opening between the two outer openings, and wherein the two outer openings are configured to receive two pegs of the block separated by a peg separation distance when the coupling end engages the block.

16. The tool according to claim 10, wherein:

the body defines a lengthwise direction that extends from a first end portion of the body to a second end portion of the body, the at least one peg has a central axis oriented parallel to the lengthwise direction of the body, and the moving member moves generally linearly between the first position and the second position and generally parallel to the lengthwise direction.

17. The tool according to claim 16, wherein the contact surface is oriented in a direction that is perpendicular to the central axis of the at least one peg.

18. A tool for use with a set of toy construction elements, comprising:

a body and a moving member, the moving member including at least one peg, wherein the moving member has a contact surface configured to be contacted by a user for actuating the moving member, the body including a coupling end, the coupling end including at least one opening, the moving member being moveable along the body between a first position and a second position, wherein as the moving member moves between the first position and the second position, the at least one peg moves through the at least one opening, wherein the body defines a lengthwise direction that extends from a first end portion of the body to a second end portion of the body, wherein the at least one peg has a central axis oriented parallel to the lengthwise direction of the body, wherein the contact surface is oriented in a direction that is perpendicular to the central axis of the at least one peg, and wherein the coupling end includes a tapered projecting portion that extends in the lengthwise direction and that is configured to contact a side of a block in the set of toy construction elements when the coupling end engages the block.

19. A tool for use with a set of toy construction elements, comprising:

a body, the body defining a lengthwise direction; and a moving member including at least one peg, the body including a coupling end within which at least one opening is recessed, the moving member being movable along the body between a first position and a second position, wherein as the moving member moves between the first position and the second position, the at least one peg moves through the at least one opening, the at least one opening comprising a first opening, a second opening, and an intermediate opening between and adjacent to the first opening and the second opening, wherein the first opening, the second opening, and the intermediate opening are continuous, the at least one peg comprising two pegs corresponding to two of the first opening, the second opening, or the intermediate opening, the coupling end having an outer perimeter that lies in a plane perpendicular to the lengthwise direction, the outer perimeter comprising a first edge, a second edge, a third edge, and a fourth edge, wherein a center of the first opening and a center of the second opening are spaced apart by a peg separation distance, and wherein each of the first edge, the second edge, the third edge, and the fourth edge lies within the peg separation distance of at least one of the first opening or the second opening.

20. The tool according to claim 19, wherein the coupling end includes a base coupling portion and a tapered projecting portion that extends from the base coupling portion along the lengthwise direction and that is configured to contact a side of a block in the set of toy construction elements when the coupling end engages the block, and wherein the base coupling portion defines an engagement surface that is perpendicular to the lengthwise direction and within which the first opening, the second opening, and the intermediate opening are recessed.

* * * * *